US005272050A

United States Patent [19]

Matsushita et al.

[11] Patent Number: 5,272,050

[45] Date of Patent: Dec. 21, 1993

[54] SILVER HALIDE PHOTOGRAPHIC MATERIAL

[75] Inventors: Tetsunori Matsushita; Yoko Idogaki, both of Minami-ashigara, Japan

[73] Assignee: Fuji Photo Film Co., Ltd., Kanagawa, Japan

[21] Appl. No.: 910,966

[22] Filed: Jul. 9, 1992

[30] Foreign Application Priority Data

Jul. 11, 1991 [JP] Japan ..... 3-196023

[51] Int. Cl.[5] ..... G03C 1/84

[52] U.S. Cl. ..... 430/522; 430/510; 430/517

[58] Field of Search ..... 430/522, 510, 517

[56] References Cited

U.S. PATENT DOCUMENTS

| | | | |
|---|---|---|---|
| 2,493,747 | 1/1950 | Brooker et al. | 430/577 |
| 2,843,486 | 7/1958 | Bailey | 430/522 |
| 4,420,555 | 12/1983 | Krueger et al. | 430/507 |
| 5,213,956 | 5/1993 | Diehl et al. | 430/522 |

*Primary Examiner*—Jack P. Brammer
*Attorney, Agent, or Firm*—Sughrue, Mion, Zinn, Macpeak & Seas

[57] ABSTRACT

There is disclosed a silver halide photographic material, which comprises a compound represented by the following formula (I):

Formula (I)

wherein $R_1$ and $R_2$ each represent a hydrogen atom or a group being capable of substitution; W represents a nitrogen atom or a carbon atom; Z represents $—Y_1—(R_3)_{n2}$ or $R_3$ in which $R_3$ represents a hydrogen atom or a group being capable of substitution; $n_0$, $n_1$, and $n_2$ each are 0 or 1; h is 1 or 2; $R_1$, $R_2$, and $R_3$ may bond together to form a carbocyclic ring or a heterocyclic ring; when $n_1$ and $n_2$ each are 1, $Y_1$ represents —CO—, $—C(=NR_4)—$, —C(=S)—, $—C(=N^+R_5R_6)—$, —SO—, $—SO_2—$, $—C(=CR_7R_8)—$, $—R_6C=N—$, or $—R_6C=CR_9—$, in which $R_4$, $R_5$, $R_6$, $R_7$, $R_8$, and $R_9$ each represent a hydrogen atom or a group being capable of substitution; when $n_1$ and $n_2$ each are 0, $Y_1$ represents a cyano group or a nitro group; X represents a divalent linking group bonded to the carbon atom through a heteroatom; $Q_1$ represents an electron-attractive group; $Q_2$ represents a group for stabilizing the negative charge that will result from the addition of a nucleophilic agent to the adjacent unsaturated bond; $Q_3$ represents a divalent linking group; M represents a furan ring or a benzofuran ring; L represents a $(m_1+1)$-valent linking group; B represents a group capable of making the compound water-soluble; $m_0$ is 0 or 1; and $m_1$ and $m_2$ each are 1, 2, or 3.

19 Claims, No Drawings

SILVER HALIDE PHOTOGRAPHIC MATERIAL

FIELD OF THE INVENTION

The present invention relates to a silver halide photographic material, and more particularly to a silver halide photographic material having at least one layer containing a novel light-absorbing compound that can be contained favorably in a layer of photographic material and that can be decolored by development processing without causing residual color stain.

BACKGROUND OF THE INVENTION

Generally, in silver halide photographic materials, for the purpose of adjusting sensitivity, improving safelight aptitude, adjusting color temperature of light, preventing halation, or adjusting balance of sensitivity in multi-layer color photographic materials, it is conventionally practiced that a light-absorbing compound is contained in a silver halide emulsion layer or other hydrophilic colloid layer, so that light having a specific wavelength may be absorbed.

For example, silver halide photographic materials have a support on which hydrophilic colloid layers, including a photosensitive silver halide emulsion layer, are formed, and when said photosensitive silver halide emulsion layer is exposed to light image-wise to record an image, it is required to control the spectral energy distribution of the entering ray into the said silver halide emulsion layer in order to improve photosensitive sensitivity. In this case, usually, a technique is taken wherein only light in the intended wavelength range is allowed to transmit, by incorporating a dye capable of absorbing light in the wavelength range undesired for said photographic silver halide emulsion layer into a hydrophilic colloid layer located farther away from the support than the said photographic silver halide emulsion layer, thereby allowing the hydrophilic colloid layer to act as a filter layer.

As for antihalation layers, for the purpose of improving sharpness of an image, an antihalation layer is provided between a photosensitive emulsion layer and a support or to the back of a support, so that detrimental reflected light at the interface between the emulsion layer and the support or at the back of the support is absorbed, thereby improving sharpness of the image.

Further, for the purpose of increasing sharpness of an image, a dye capable of absorbing light in the wavelength range in which a silver halide is photosensitive is used in a silver halide emulsion layer, to prevent irradiation.

Particularly, in silver halide photographic materials used in photomechanical processes, more particularly in photographic materials for daylight rooms, a dye for absorbing UV rays or visible light is added to photosensitive layers or to a layer located between a light source and photosensitive layers, in order to increase safety against light from a safelight.

In X-ray photographic materials, in some cases, a colored layer for improving sharpness is provided so as to act as a crossover cut filter for decreasing crossover light.

In many cases, these layers to be colored are made up of a hydrophilic colloid, and therefore generally for the coloring a dye is contained in the layer. The dye is required to meet, for example, the following conditions.

(1) The dye has spectral absorption appropriate to the intended purpose.

(2) The dye is photographically inactive. That is, the dye does not detrimentally affect chemically the performance of silver halide emulsion layers, for example it does not lower sensitivity or cause latent image fading or fogging.

(3) The dye can be decolored or dissolved and removed in photographic processing steps, so that no detrimental color will remain on the photographic material after the processing.

(4) The dye is excellent in stability after a lapse of time and keeps the quality in the coating liquid (solution) or the silver halide photographic material.

Efforts have been made to find dyes that meet these conditions. For example, pyrazoloneoxonol dyes described in British Patent No. 506,385, barbituric acid oxonol dyes described in U.S. Pat. No. 3,247,127, azo dyes described in U.S. Pat. No. 2,390,707, styryl dyes described in U.S. Pat. No. 2,255,077, hemioxonol dyes described in British Patent No. 584,609, merocyanine dyes described in U.S. Pat. No. 2,493.747,, cyanine dyes described in U.S. Pat. No. 2,843,486, and methylenetype benzylidene dyes described in U.S. Pat. No. 4,420,555 can be mentioned.

To secure that the layer containing the above dye serves as a filter layer or an antihalation layer, it is required that the particular layer be selectively colored, and substantially the coloring should not affect other layers. This is because if the other layer is substantially colored, not only the other layer is spectrally affected detrimentally but also the effect of the filter layer or the antihalation layer is reduced. If the dye added to a particular layer to prevent irradiation diffuses and colors other layers, a problem similar to the above will occur.

To solve this problem, conventionally a means is known wherein a so-called acid dye having a sulfo group or a carboxyl group is localized in a specific layer using a mordant.

Such a mordant includes, for example, ethylenically unsaturated compound polymers having dialkylaminoalkyl ester residues, described in British Patent No. 685,475, reaction products of polyvinyl alkylketones with a aminoguanidine described in British Patent No. 850,281, and vinylpyridinium cationic polymer and vinylpyridine polymers described in U.S. Pat. Nos. 2,548,564, 2,484,430, 3,148,061, and 3,756,814 and to make the above-mentioned acid dye effectively mordanted, cationic mordants containing secondary and tertiary amino groups, nitrogen-containing heterocyclic groups, and their quatenary cationic groups in the polymers are used.

However, if a mordant is used, when the layer to which the dye is added comes in contact with other hydrophilic layer in a wet state, diffusion of part of the dye from the former layer to the latter layer often occurs in some cases. Such diffusion of a dye depends on the chemical structure of the mordant as well as on the chemical structure of the dye used.

Further, if a polymer mordant is used, after photographic processing, in particular after photographic processing whose processing time is shortened, colored residue is particularly liable to remain on the photographic material. It is considered that although the bonding strength of the mordant to the dye becomes considerably weak in an alkaline solution, such as a developer, some bonding strength still remains and therefore the dye or reversibly decolored products remain in the layer containing the mordant.

However, these cationic mordants statically interact with gelatin often used as a hydrophilic colloid and a surface-active agent having an alcoholate group, a carboxylate group, a sulfonate group, or a sulfate group, which agent is used commonly as a coating auxiliary, leading to deterioration of coating properties in some cases.

In some cases of color photographic materials, desilvering properties are deteriorated and the sensitivity of the adjacent emulsion layers is lowered.

It is frequently noticed that the above-mentioned acid dye used together with such a mordant diffuses into another layer, and therefore it is considered to use a large amount of a mordant to obviate the diffusion, but not only can the diffusion not be obviated completely, also the thickness of the layer in which the acid dye is contained increases, which disadvantageously causes the sharpness to lower.

In photographic materials for printing reproduction, generally a reducing operation using a reducing solution for adjusting the concentration, the gradation, etc., is performed, and since the reducing solution contains a water-soluble iron complex as a reducer, when the above-mentioned cationic mordant is used, the cationic mordant bonds statically to the iron complex, thereby disadvantageously causing yellow stain due to the iron complex.

These disadvantages can be improved by the use of a dye described in JP-A ("JP-A" means unexamined published Japanese patent application) No. 280246/1988, but there is a defect that the decoloring property is unsatisfactory, particularly in low-pH rapid processing.

In the case of color photographic materials, for the purpose of absorbing yellow light and of preventing halation, colloidal silver is conventionally used. This colloidal silver causes, however, a problem that the photosensitive silver halide emulsion layer adjacent to the colloidal silver layer increases in fogging, which is desired to be solved.

As other means of retaining a dye in a particular layer of a photographic material, techniques are known as described in JP-A Nos. 12639/1981, 155350/1980, 155351/1980, 92716/1977, 197943/1988, 27838/1988, and 40827/1989, European Patent Nos. 0015601 B 1 and 0276566 A 1, and International Patent Application Publication No. 88/04794, in all of these a dye is permitted to present in a dispersed solid form.

However, when a dye is made to be in a dispersed solid form, as is described in the above-mentioned International Patent Application Publication No. 88/04794, it is apparent that the absorption peak of the absorption spectrum of the covering of the dispersed solid shifts in comparison with the absorption spectrum of the solution of the same dye or with the absorption spectrum of the dye dissociated at a pH of 10, so that the half band width (HBW) is characteristically broadened.

If the half band width is broadened, some cases are suitable for application to filters, wherein exposure to light in a wide wavelength range is required, but there is a defect that the value of the absorbance decreases generally. Further, in multilayer silver halide photographic materials, the too broad half band width is disadvantageous, on the contrary, in the application to filters, such as yellow filters and magenta filters, wherein light having undesired wavelengths in the spectral sensitivity region at a lower layer are to be cut, and when a dispersed solid dye is used as a safelight filter layer, as described in JP-A No. 110453/1990. Further, when a dispersed solid dye is used in an antihalation layer of a sensitive layer whose spectral sensitive region is present in a very narrow wavelength region, or is used in an antihalation layer of a case that will be exposed to light in a very narrow wavelength region, that the absorbance is low requires a large amount of a dye for coating, resulting in many disadvantages, for example that decoloring properties are deteriorated, that the thickness of the film is increased, and that the cost increases.

SUMMARY OF THE INVENTION

Therefore, the first object of the present invention is to provide a silver halide photographic material wherein a hydrophilic colloid layer is colored with a dye that can be decolored irreversibly by photographic processing and that does not influence adversely the photographic properties of the photographic emulsions.

The second object of the present invention is to provide a silver halide photographic material wherein only a desired hydrophilic colloid layer is dyed well selectively with a dye and a hydrophilic colloid layer is provided that can be excellently decolored by photographic processing (particularly low-pH rapid processing).

The third object of the present invention is to provide a novel method of immobilizing a dye whose absorbance is high and whose absorption is sharp.

The fourth object of the present invention is to provide a silver halide photographic material wherein the interaction between gelatin and coating auxiliary is suppressed and at least one layer colored with a dye improved in coating properties is provided.

The above and other objects, features, and advantages of the invention will become apparent in the following description.

DETAILED DESCRIPTION OF THE INVENTION

The above objects have been achieved by a silver halide photographic material, which comprises at least one compound represented by the following formula (I):

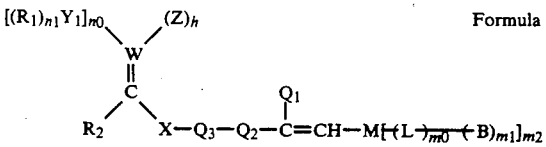

Formula (I)

wherein $R_1$ and $R_2$ each represent a hydrogen atom or a group being capable of substitution; W represents a nitrogen atom or a carbon atom; Z represents $—Y_1—(R_3)_{n2}$ or $R_3$ in which $R_3$ represents a hydrogen atom or a group being capable of substitution; $n_0$, $n_1$, and $n_2$ each are 0 or 1; h is 1 or 2; $R_1$, $R_2$, and $R_3$ may bond together to form a carbocyclic ring or a heterocyclic ring; when $n_1$ and $n_2$ each are 1, $Y_1$ represents —CO—, $—C(=NR_4)—$, —C(=S)—, $—C(=N^+R_5R_6)—$, —SO—, $—SO_2—$, $—C(=CR_7R_8)—$, $—R_6C=N—$, or $—R_6C=CR_9—$, in which $R_4$, $R_5$, $R_6$, $R_7$, $R_8$, and $R_9$ each represent a hydrogen atom or a group being capable of substitution; when $n_1$ and $n_2$ each are 0, $Y_1$ represents a cyano group or a nitro group; X represents a divalent linking group bonded to the carbon atom through a heteroatom; $Q_1$ represents an electron-attractive group; $Q_2$ represents a group for stabilizing the negative charge that will result from the addition of a nucleophilic agent to the adjacent unsaturated bond; $Q_3$ represents a divalent linking group; M represents a furan ring or a benzofuran ring; L represents a $(m_1+1)$-valent linking group; B represents a group capable of making the compound water-soluble (hereinafter referred to water-solubilizing group); $m_0$ is 0 or 1; and $m_1$ and $m_2$ each are 1, 2, or 3.

The compound represented by formula (I) is a compound whose C-X bond can be severed by the addition of a nucleophilic agent (e.g., an $OH^-$ ion, an $SO_3^{2-}$ ion, and hydroxylamine) present in a processing solution to the unsaturated bond by processing in photography (e.g., by development, bleaching, fixing, and bleach-fixing).

As methods for blocking the active group by using the addition of a nucleophilic agent to the unsaturated double bond, those described in JP-A Nos. 201057/1984, 43739/1986, 95347/1986, and 245255/1989 can be used.

Now formula (I) will be described in detail.

$R_1$ represents a hydrogen atom or a group being capable of substitution, such as an alkyl group (preferably having 1 to 20 carbon atoms), an alkenyl group (preferably having 2 to 20 carbon atoms), an aryl group (preferably having 6 to 20 carbon atoms), an alkoxy group (preferably having 1 to 20 carbon atoms), an aryloxy group (preferably having 6 to 20 carbon atoms), an alkylthio group (preferably having 1 to 20 carbon atoms), an arylthio group (preferably 6 to 20 carbon atoms), an amino group (e.g., an unsubstituted amino group and a secondary or tertiary amino group preferably substituted by an alkyl group having 1 to 20 carbon atoms or an aryl group having 6 to 20 carbon atoms), or a hydroxyl group, which substituents may have one or more below-mentioned substituents which may be the same or different.

Specifically the substituent includes a halogen atom (e.g., fluorine, chlorine, and bromine), an alkyl group (preferably having 1 to 20 carbon atoms), an aryl group (preferably having 6 to 20 carbon atoms), an alkoxy group (preferably having 1 to 20 carbon atoms), an aryloxy group (preferably having 6 to 20 carbon atoms), an alkylthio group (preferably having 1 to 20 carbon atoms), an arylthio group (preferably having 6 to 20 carbon atoms), an acyl group (preferably having 2 to 20 carbon atoms), an acylamino group (preferably an alkanoylamino group having 1 to 20 carbon atoms and a benzoylamino group having 6 to 20 carbon atoms), a nitro group, a cyano group, an oxycarbonyl group (preferably an alkoxycarbonyl group having 1 to 20 carbon atoms and an aryloxycarbonyl group having 6 to 20 carbon atoms), a hydroxyl group, a carboxyl group, a sulfo group, a ureido group (preferably an alkylureido group having 1 to 20 carbon atoms and an arylureido group having 6 to 20 carbon atoms), a sulfonamido group (preferably an alkylsulfonamido group having 1 to 20 carbon atoms and an arylsulfonamido group having 6 to 20 carbon atoms), a sulfamoyl group (preferably an alkylsulfamoyl group having 1 to 20 carbon atoms and an arylsulfamoyl group having 6 to 20 carbon atoms), a carbamoyl group (preferably an alkylcarbamoyl group having 1 to 20 carbon atoms and an arylcarbamoyl group having 6 to 20 carbon atoms), an acyloxy group (preferably having 1 to 20 carbon atoms), an amino group (e.g., an unsubstituted amino group and a secondary or tertiary amino group preferably substituted by an alkyl group having 1 to 20 carbon atoms or an aryl group having 6 to 20 carbon atoms), a carbonate group (preferably an alkyl carbonate group having 1 to 20 carbon atoms and an aryl carbonate group having 6 to 20 carbon atoms), a sulfon group (preferably an alkylsulfon group having 1 to 20 carbon atoms and an arylsulfon group having 6 to 20 carbon atoms), and a sulfinyl group (preferably an alkylsulfinyl group having 1 to 20 carbon atoms and an arylsulfinyl group having 6 to 20 carbon atoms).

$R_1$, $R_2$, and $R_3$ may bond together to form a carbocyclic or heterocyclic ring (e.g., a 5- to 7-membered ring) $R_2$ and $R_3$, which may be the same or different, each represent a hydrogen atom or a group being capable of substitution. As the group of capable of being substitution, can be mentioned a halogen atom (e.g., fluorine, chlorine, and bromine), an alkyl group (preferably having 1 to 20 carbon atoms), an aryl group (preferably having 6 to 20 carbon atoms), an alkoxy group (preferably having 1 to 20 carbon atoms), an aryloxy group (preferably having 6 to 20 carbon atoms), an alkylthio group (preferably having 1 to 20 carbon atoms), an arylthio group (preferably having 6 to 20 carbon atoms), an acyloxy group (preferably having 2 to 20 carbon atoms), an amino group (e.g , an unsubstituted amino group and a secondary or tertiary amino group preferably substituted by an alkyl group having 1 to 20 carbon atoms or an aryl group having 6 to 20 carbon atoms), a carbonamido group (preferably an alkylcarbonamido group having 1 to 20 carbon atoms and an arylcarbonamido group having 6 to 20 carbon atoms), a ureido group (preferably an alkylureido group having 1 to 20 carbon atoms and an arylureido group having 6 to 20 carbon atoms), a carboxyl group, a carbonate group (preferably an alkyl carbonate group having 1 to 20 carbon atoms and an aryl carbonate group having 6 to 20 carbon atoms), an oxycarbonyl group (preferably an alkyloxycarbonyl group having 1 to 20 carbon atoms and an aryloxycarbonyl group having 6 to 20 carbon atoms), a carbamoyl group (preferably an alkylcarbamoyl group having 1 to 20 carbon atoms and an arylcarbamoyl group having 6 to 20 carbon atoms), an acyl group (preferably an alkylcarbonyl group having 1 to 20 carbon atoms and an arylcarbonyl group having 6 to 60 carbon atoms), a sulfo group, a sulfonyl group (preferably an alkylsulfonyl group having 1 to 20 carbon atoms and an arylsulfonyl group having 6 to 20 carbon atoms), a sulfinyl group (preferably an alkylsulfinyl group having 1 to 20 carbon atoms and an arylsulfinyl group having 6 to 20 carbon atoms), a sulfamoyl group (preferably an alkyl sulfamoyl group having 1 to 20 carbon atoms and an arylsulfamoyl group having 6 to 20 carbon atoms), a cyano group, and a nitro group.

The substituent represented by $R_2$ and $R_3$ may have one or more substituents, which may be the same or different, such as those mentioned for $R_1$ above.

When $n_1$ and $n_2$ each are 1, $Y_1$ represents —CO—, —C(=$NR_4$)—, —(C=S)—, C(=$N^+R_5R_6$)—, —SO—, —$SO_2$, —C(=$CR_7R_8$)—, —$R_6$C=N—, or —$R_6$C=C-$R_9$—, and when $n_1$ and $n_2$ each are 0, $Y_1$ represents a cyano group or a nitro group. $R_4$, $R_5$, $R_6$, $R_7$, $R_8$, and $R_9$, which may be the same or different, each represent a hydrogen atom or a group being capable of substitution.

As specific substituents contained in $Y_1$, can be mentioned a halogen atom (e.g., fluorine, chlorine, and bromine), an alkyl group (preferably having 1 to 20 carbon atoms), an alkenyl group (preferably 2 to 20 carbon atoms), an aryl group (preferably having 6 to 20 carbon atoms), an alkoxy group (preferably having 1 to 20 carbon atoms), an aryloxy group (preferably having 6 to 20 carbon atoms), an acyloxy group (preferably having 2 to 20 carbon atoms), an amino group (e.g., an unsubstituted amino group and a secondary or tertiary amino group preferably substituted by an alkyl group having 1 to 20 carbon atoms or an aryl group having 6 to 20 carbon atoms), a carbonamido group (preferably an alkylcarbonamido group having 1 to 20 carbon atoms and an arylcarbonamido group having 6 to 20 carbon atoms), a ureido group (preferably an alkylureido group having 1 to 20 carbon atoms and an arylureido group having 6 to 20 carbon atoms), an oxycarbonyl group (preferably an alkyloxycarbonyl group having 1 to 20 carbon atoms and an aryloxycarbonyl group having 6 to 20 carbon atoms), a carbamoyl group (preferably an alkylcarbamoyl group having 1 to 20 carbon atoms and an arylcarbamoyl group having 6 to 20 carbon atoms), an acyl group (preferably an alkylcarbonyl group having 1 to 20 carbon atoms and an arylcarbonyl group having 6 to 20 carbon atoms), a sulfonyl group (preferably an alkylsulfonyl group having 1 to 20 carbon atoms and an arylsulfonyl group having 6 to 20 carbon atoms), a sulfinyl group (preferably an alkylsulfinyl group having 1 to 20 carbon atoms and an arylsulfinyl group having 6 to 20 carbon atoms), a sulfamoyl group (preferably an alkylsulfamoyl group having 1 to 20 carbon atoms and an arylsulfamoyl group having 6 to 20 carbon atoms), a cyano group, and a nitro group. Preferable substituents represented by $R_7$ and $R_8$ include an oxycarbonyl group, a carbamoyl group, an acyl group, a sulfonyl group, a sulfamoyl group, a sulfinyl group, a cyano group, and a nitro group. These substituents may have one or more substituents, which may be the same or different, and specific substituents are the same ones as those mentioned for $R_1$.

$Q_1$ represents an electron-attractive group and $Q_2$ represents an active group for stabilizing the negative charge that will result from the addition of a nucleophilic agent to the adjacent unsaturated bond. M represents a furan ring or a benzofuran ring. The photographic dye made up of these $Q_1$, $Q_2$, and M itself cannot dye selectively the layer where it is added and is a dye that will dissolve out from the photographic material or will undergo, for example, a discoloring reaction whereby substantially leaving no stain, residual color, or the like, when subjected to photographic processing (development processing, bleaching, fixing, washing, etc.).

That is, the compound of the present invention is characterized in that, in the blocked state as shown by formula (I), it is nondiffusible and the dye section capable of dying selectively the layer to which the compound is added is diffusible.

It is an UV absorbing dye whose absorption wave length region is mainly a region where the wavelength is shorter than 400 nm.

As the electron-attractive group represented by $Q_1$, a cyano group, $-COOR_{10}$, $-C(=O)-R_{10}$, $-SOR_{10}$, $-SO_2R_{10}$, $-SO_2NR_{10}R_{11}$, and $-ONR_{10}R_{11}$ can be mentioned, wherein $R_{10}$ and $R_{11}$ each represent a hydrogen atom or a group being capable of substitution.

The group represented by $Q_2$ is represented by the following formula (II):

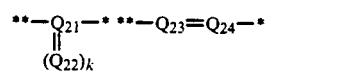

Formula (II)

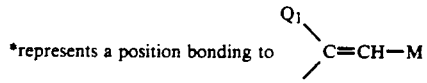

*represents a position bonding to

**represents a position bonding to $Q_3$ wherein $Q_{21}$ represents a carbon atom or a sulfur atom, $Q_{22}$ represents an oxygen atom, $=N-R_{12}$, or $=CR_{12}R_{13}$, $Q_{23}$ represents $-CR_{14}=$ or $=N=$, and $Q_{24}$ represents $=CR_{15}$ or $=N-$ in which $R_{12}$, $R_{13}$, $R_{14}$, $R_{15}$ each represent a hydrogen atom or a group being capable of substitution, and k is 1 or 2. Preferable examples of $Q_2$ include $-CO-$, $-SO_2-$, $-SO-$, $-CR_{16}=CR_{17}-$, $-N=N-$, $-CR_{18}=N-$, $-N=CR_{19}-$, wherein $R_{16}$, $R_{17}$, $R_{18}$, $R_{19}$ each have the same meaning as that of $R_{12}$, $R_{13}$, $R_{14}$, or $R_{15}$.

Among these, those wherein $Q_1$ stands for a cyano group are particularly preferable.

$Q_3$ represents a divalent linking group made up of a straight-chain or branched chain alkylene group (preferably having 1 to 6 carbon atoms), a straight-chain or branched chain alkenylene group (preferably having 2 to 6 carbon atoms), an arylene group (preferably a phenylene group), a straight-chain or branched chain aralkylene group (preferably a benzylene group), or the like and an oxygen atom, a nitrogen atom, or a sulfur atom.

Herein $Q_1$, $Q_2$, and $Q_3$ may bond together to form a carbocyclic ring or heterocyclic ring.

Such a ring may be an acid carbocyclic ring, for example, dimedone and 1,3-indanedione, with preference given to the formation of an acid heteroaromatic ring. As such an acid heteroaromatic ring, pyrazolone, hydroxypyridone, barbituric acid, pyrazolopyridone, pyrazolidinedione, furanone, thiobarbituric acid, rhodanine, hydantoin, oxazolidin-4-one-2-thione, pyrimidine-2,4-dione, homophthalimide, 1,2,3,4-tetrahydroquinolin-2,4-dione, 2-isoxazolin-5-one, pyrazolopyrimidine, pyrrolidone, pyrazoloimidazole, and pyrazolotriazole can be mentioned. Out of these, pyrazolone, hydroxypyridone, barbituric acid, pyrazolopyridone, pyrazolidinedione, furanone, and 2-isoxazolin-5-one are particularly preferable.

As the group being capable of substitution that is represented by $R_{10}$, $R_{11}$, $R_{12}$, $R_{13}$, $R_{14}$, and $R_{15}$, an alkyl group (preferably having 1 to 20 carbon atoms), an alkenyl group (preferably having 2 to 20 carbon atoms), an aryl group (preferably having 6 to 20 carbon atoms), an alkoxy group (preferably 1 to 20 carbon atoms), an aryloxy group (preferably having 6 to 20 carbon atoms), an alkylthio group (preferably 1 to 20 carbon atoms), an arylthio group (preferably having 6 to 20 carbon atoms), an amino group (e.g., an unsubstituted amino group and a secondary or tertiary amino group preferably substituted by an alkyl group having 1 to 20 carbon atoms or an aryl group having 6 to 20 carbon atoms), and a hydroxyl group can be mentioned, each of which can have one or more below mentioned substituents, which may be the same or different.

Herein specific substituents may include the same substituents as those of $R_1$.

X represents a divalent linking group bonded through a heteroatom to the carbon atom whose C-X bond can be split when processed. As specific examples of the group represented by X, —O—, —OCO—, —$SO_2$—, and —$OCO_2$— can be mentioned.

L represents a $(m_1+1)$-valent linking group, which is specifically denoted by the following formula (III):

Formula (III)

wherein $L_0$ and $L_1$ each represent a divalent linking group and specific examples are a straight-chain or branched chain alkylene group (preferably having 1 to 6 carbon atoms), a straight chain or branched chain alkenylene group (preferably having 2 to 6 carbon atoms), an arylene group (preferably a phenylene group), and a straight chain or branched chain aralkylene group (preferably a benzylene group).

A represents an oxygen atom, a nitrogen atom, or a sulfur atom and $m_3$ and $m_4$ each are 0 or 1.

B represents a water-solubilizing group and specific examples are carboxylic acid group, sulfonic acid group, sulfinic acid group, phosphoric acid group, and amphoteric water-solubilizing groups.

Now specific examples of —(—L—)$_{mo}$—(—B)$_{m1}$ are shown below:

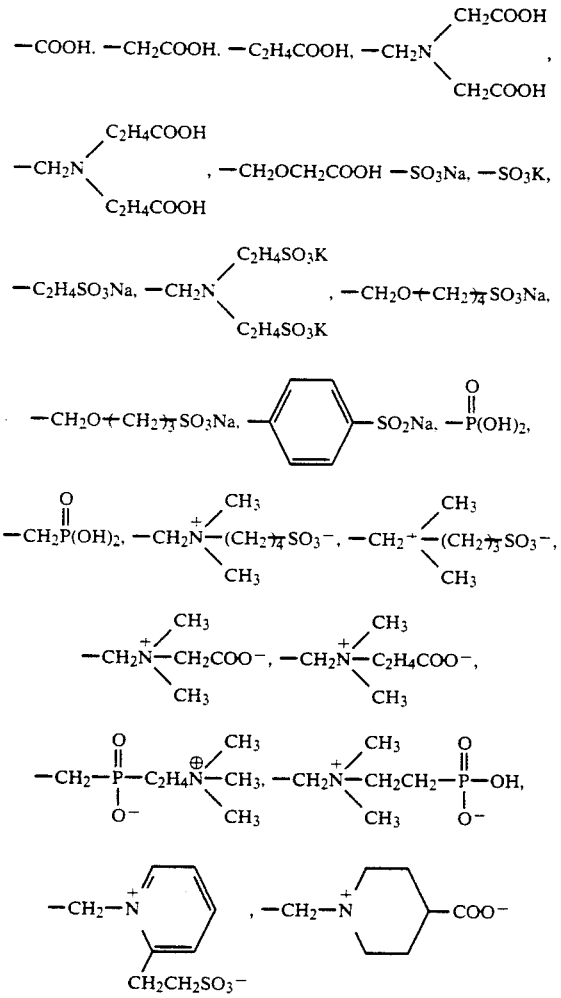

Out of the compounds represented by formula (I), preferable ones are those represented by the following formulae (IV) and (V): Formula (IV)

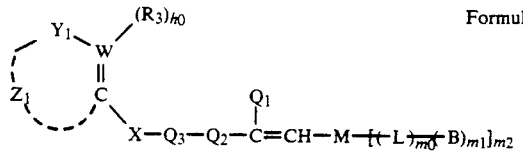

Formula (IV)

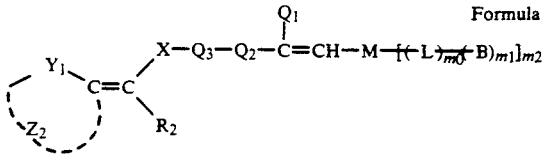

Formula (V)

In formula (IV), $Z_1$ represents a group of atoms required to form a carbocyclic ring or heterocyclic ring, W represents a carbon atom or a nitrogen atom, $R_3$ have the same meaning as that of $R_3$ of formula (I), and $h_0$ is 0 or 1.

Specific examples of the carbocyclic ring and the heterocyclic ring formed by $Z_1$ are cyclopentenone, cyclohexenone, cycloheptenone, benzocycloheptenone, benzocyclopentenone, benzocyclohexenone, 4-pyridone, 4-quinolone, quinone-2-pyrone, 4-pyrone, 1-thio-2-pyrone, 1-thio-4-pyrone, cumarin, chromone, uracil, imidazoline, thiazoline, oxazoline, pyrrole, oxazole, thiazole, imidazole, triazole, tetrazole, pyridine, pyrimidine, pyrazine, pyridazine, and triazine and condensed rings formed by condensing these at a suitable position, whose specific examples are quinoline, isoquinoline, phthalazine, quinazoline, quinoxaline, benzothiazole, benzoxazole, benzoimidazole, naphthilidine, thiazolo[4,5-d]pyrimidine, 4H-pyrido[1,2-a]pyrimidine, imidazo[1,2-a]-pyridine, pyroro[1,2-a]pyrimidine, 1H-pyroro[2,3-b]-pyridine, 1H-pyroro[3,2-b]pyridine, 6H-pyroro[3,4-b]-pyridine, benzoimidazole, triazaindenes (e.g., pyrido[3,4-d]pyridazine, pyrido[3,4-d]pyrimidine, imidazo[1,5-a]pyrimidine, pyrazolo[1,5-a]pyrimidine, 1H-imidazo[4,5-b]pyridine, and 7H-pyroro[2,3-d]pyrimidine), tetraazaindenes (e.g., pteridine, 4H-imidazo[1,2-b][1,2,4]triazole, imidazo[4,5-d]imidazole, 1H-1,2,4-triazolo[4,3-b]pyridazine, 1,2,4-triazolo[1,5-a]-pyrimidine, imidazo[1,2-a]-1,3,5-triazine, pyrazolo[1,5-a]1,3,5-triazine, 7H-purine, 9H-purine, and 1H-pyrazolo[3,4-d]pyrimidine), and pentaazaindenes (e.g., [1,2,4]triazolo[1,5-a][1,3,5]triazine, 1,2,4-triazolo[3,4-f][1,2,4]triazine, and 1H-1,2,3-triazolo[4,5-d]pyrimidine). Besides, there can be mentioned such compounds as follows:

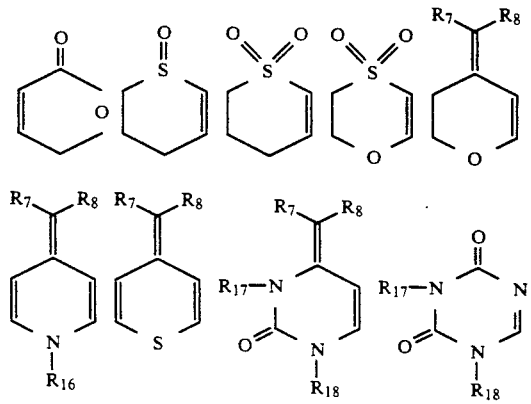

-continued

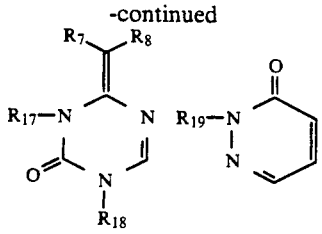

wherein $R_7$ and $R_8$ have the same meanings as those defined in formula (I), and $R_{16}$, $R_{17}$, $R_{18}$, and $R_{19}$ each represent a hydrogen atom or an alkyl group having 1 to 20 carbon atoms, an alkenyl group, an aryl group, an aralkyl group, or an acyl group.

Out of the carbocyclic groups and heterocyclic groups formed by $Z_1$, preferable ones are cyclopentenones, cyclohexenones, quinones, cumarin, chromone, uracils, and nitrogen-containing aromatic heterocyclic rings.

Out of the nitrogen-containing aromatic heterocyclic rings, particularly preferable ones are pyridine, pyrimidine, pyrazine, triazine, quinoline, quinazoline, quinoxaline, triazaindenes, tetraazaindenes, and pentaazaindenes, with triazaindenes, tetraazaindenes, and pentaazaindenes being more particularly preferred.

Preferable substituents of $R_3$ are a hydrogen atom, a halogen atom, an arylthio group, an oxycarbonyl group, a carbamoyl group, an acyl group, a sulfonyl group, a sulfamoyl group, a sulfinyl group, a nitro group, and a cyano group.

$Z_2$ in formula (IV) has the same meaning as that of $Z_1$ in formula (III) and $R_2$ has the same meaning as that of $R_2$ in formula (I).

As examples of the carbocyclic ring and the heterocyclic ring formed by $Z_2$, a cyclopentanone, a cyclohexanone, a cycloheptanone, a benzocycloheptanone, a benzocyclopentanone, a benzocyclohexanone, 4-tetrahydropyridone, 4-dihydroquinolone, and 4-tetrahydropyrone can be mentioned with preference given to a cyclohexanone and a cycloheptanone.

Particularly preferable ones are those represented by formula (IV).

Specific examples of the compound used in the present invention are given below, but the present invention is not restricted to them.

(1)

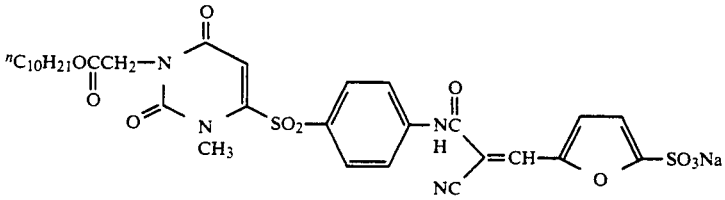

(2)

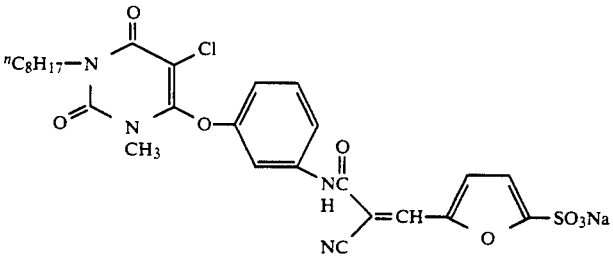

(3)

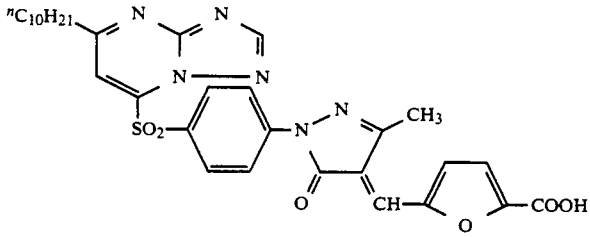

(4)

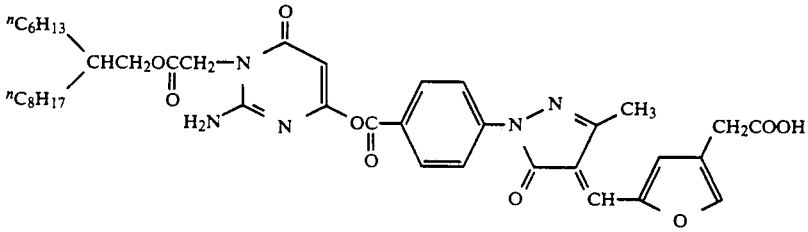

-continued
(5)
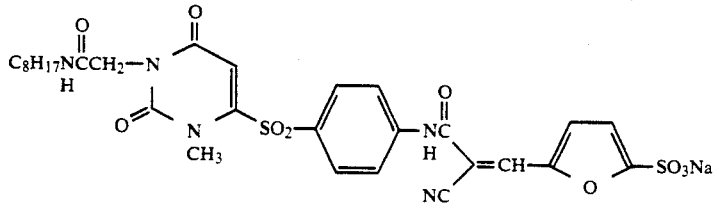
(6)
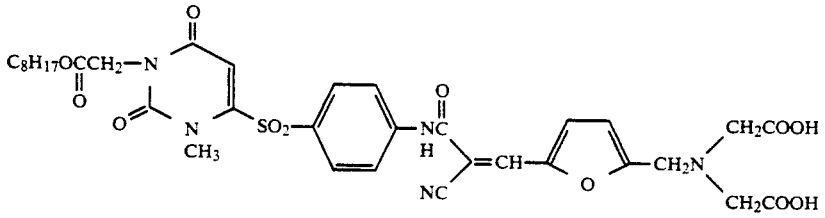
(7)
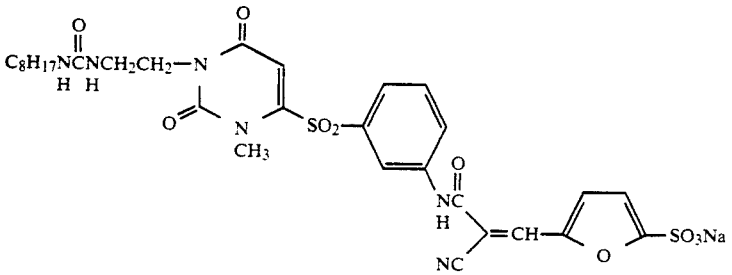
(8)
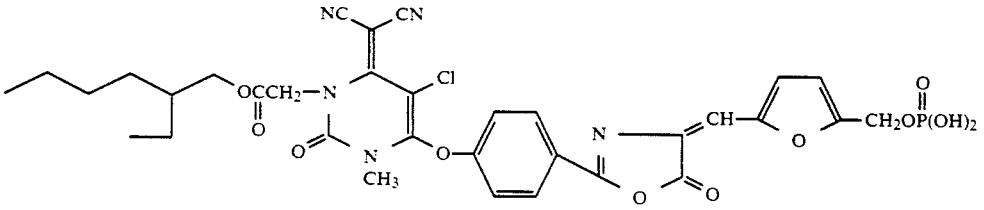
(9)
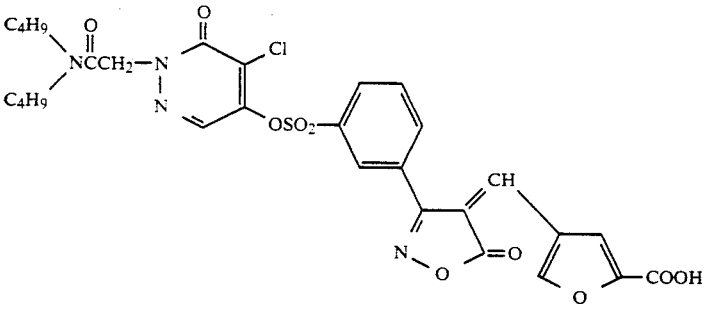
(10)
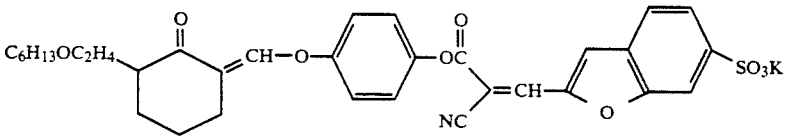
(11)
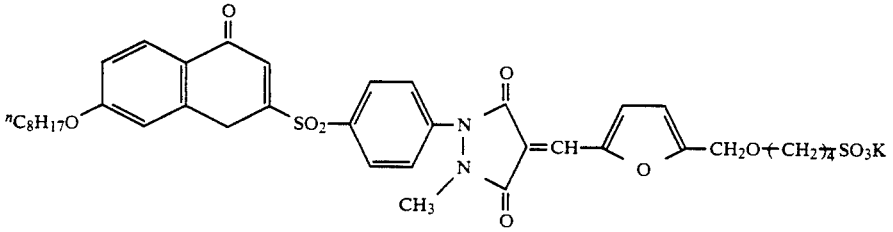

-continued
(12)
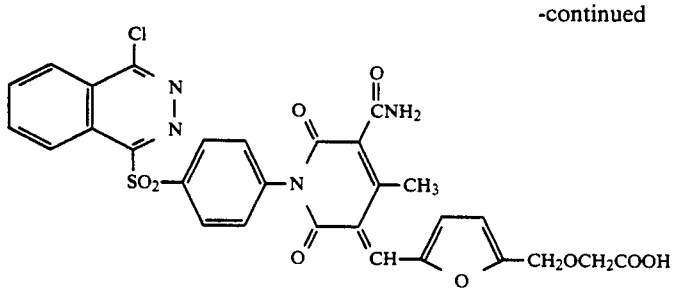
(13)
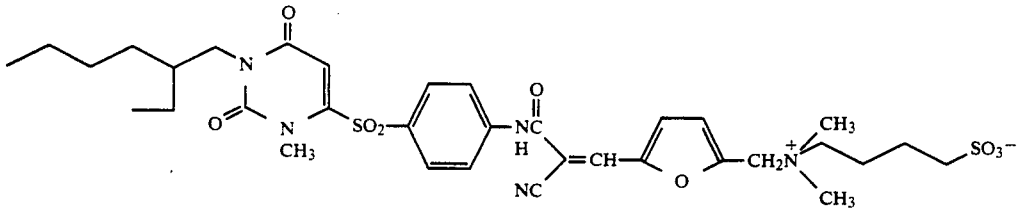
(14)
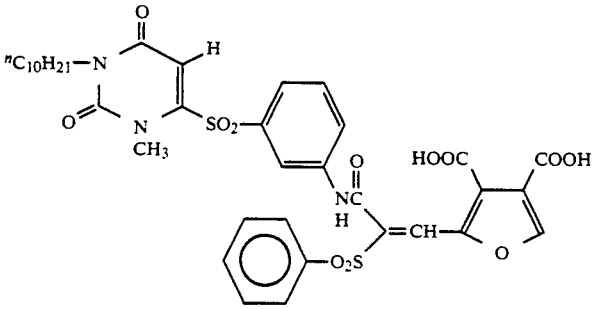
(15)
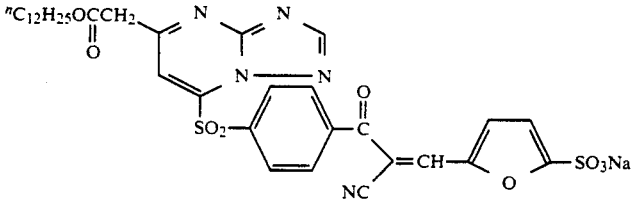
(16)
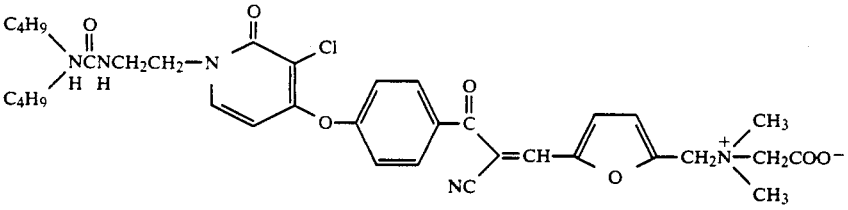
(17)
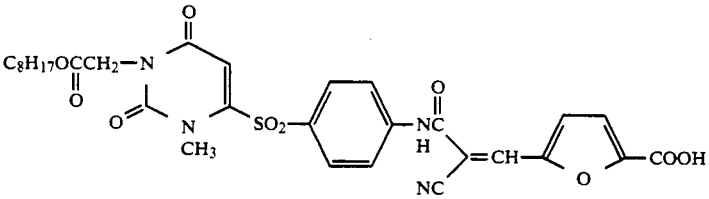
(18)
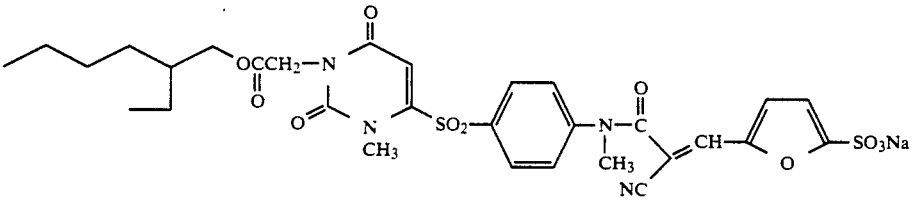

-continued (19)

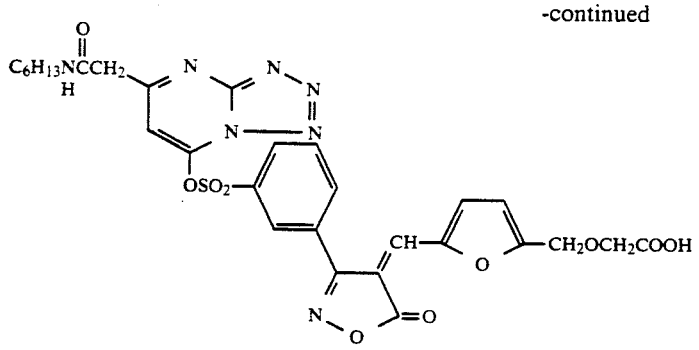

(20)

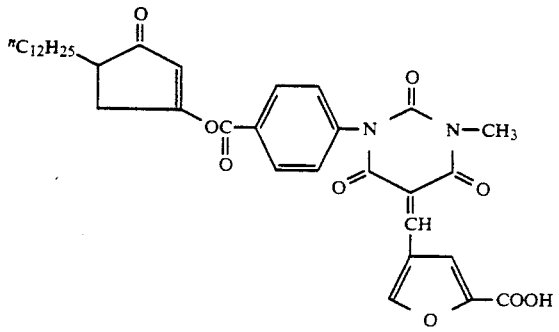

SYNTHESIS EXAMPLE 1

Synthesis of Exemplified Compound (1)

(Synthesis of the Blocked Base Moiety)

20 g of bromoacetic acid, 22 g of n-decyl alcohol, and 2.5 g of p-toluenesulfonic acid were added to 150 ml of toluene, and the azeotropic dehydration was carried out for 1.5 hours. After cooling the mixture by allowing it to stand, the toluene was removed under reduced pressure and then vacuum distillation was performed, to obtain 41 g of n-octyl bromoacetate (121° C., 10 mmHg).

Then, 15 g of 6-chloro-1-methyluracil was suspended in 50 ml of acetonitrile, and then 15 ml of DBU was added to the suspension at room temperature, to obtain a uniform solution. After stirring for 15 min, 26 g of n-decyl bromoacetate was added dropwise thereto at room temperature. After stirring for 2.5 hours at room temperature, the mixture was filtered to remove foreign matter and then the acetonitrile was removed under reduced pressure. Ethyl acetate was added to the residue, the deposited DBU HBr was removed, the filtrate was washed with diluted hydrochloric acid and then with water, and was dried over $MgSO_4$, and then the ethyl acetate was removed under reduced pressure. The residue was purified by silica gel chromatography, to obtain 31 g of an oil of 6-chloro-1-methyl-3-octyloxycarbomethyluracil (yield: 94%).

270 g of sulfanylic acid was suspended in 3 liters of acetonitrile, then 225 ml of triethylamine was added to the suspension, and then 135 g of cyanoacetic acid was added thereto. After stirring for 15 min at room temperature, a solution of 325 g of N,N'-dichlorohexylcarbodiimide (DCC) in 500 ml of acetonitrile was added dropwise slowly thereto. After the addition the mixture was heated for 2 hours under reflux. One liter of methanol was added to the reaction solution, and while the mixture was hot it was filtered, to remove the produced dicyclohexyl urea. The filtrate was cooled by allowing it to stand and the deposited crystals were filtered and dried, to obtain 490 g of triethylamine 4-(cyanomethylcarbamoyl)benzenesulfonate. 490 g of the obtained triethylamine 4-cyanomethylcarbamoyl)benzenesulfonate was suspended in 0.8 liter of acetonitrile, and then 200 ml of phosphorus oxychloride was added thereto.

After cooling the reaction liquid with ice, 100 ml of dimethylacetamide was added dropwise slowly. After the addition the mixture was stirred for 1 hour while cooling with ice, then it was further stirred for 2 hours at room temperature, followed by cooling with ice again. 100 ml of water was added slowly thereto, then after the temperature stopped rising, 5 liters of water was added, the mixture was stirred for 30 min under cooling with ice. The deposited crystals were filtered and washed with water until the filtrate became free of the acid, followed by drying, to obtain 350 g of 4-(cyanomethylcarbamoyl)-benzenesulfonyl chloride.

Then, 450 g of sodium sulfite was dissolved in 1.5 liters of water and then 350 g of the 4-(cyanomethylcarbamoyl)benzenesulfonyl chloride was added to the solution. A solution of 150 g of sodium hydroxide in 500 ml of water was added thereto dropwise over 1 hour at room temperature. Thereafter it was stirred for a further 2 hours, and when the reaction liquid became an approximately uniform solution, the undissolved matter was removed by filtration and the filtrate was cooled with ice.

A solution of 170 g of concentrated sulfuric acid in 500 ml of water was added dropwise over 30 min to the filtrate, to bring the pH of the filtrate to 1 or below. The reaction solution was stirred for 30 min under cooling with ice; then the deposited crystals were filtered and washed with water several times, to remove inorganic matter, followed by drying, to obtain 205 g of 4-(cyanomethylcarbamoyl)benzenesulfinic acid. Without purification this was then added slowly to 175 g of 28% sodium methoxide and 1.5 liters of methanol over 30 min, thereby dissolving it completely. After removing foreign matter by filtering, the methanol was removed under reduced pressure and the crystals were washed with acetonitrile and then filtered and dried, to obtain 225 g of white crystals of sodium 4-(cyanomethylcarbamoyl)-benzenesulfinate. (m.p.: 250° C. or over)

A solution of 29 g of 6-chloro-3-decyloxycarbomethyl-1-methyluracil and 20 g of the sodium 4-(cyanomethylcarbamoyl)benzenesulfinate in 200 ml of methanol was heated for 26 hours under reflux. After cooling it by allowing it to stand, the deposited crystals were filtered and washed with water and then with methanol, followed by drying, to obtain 31 g of white crystals of an Intermediate 1.

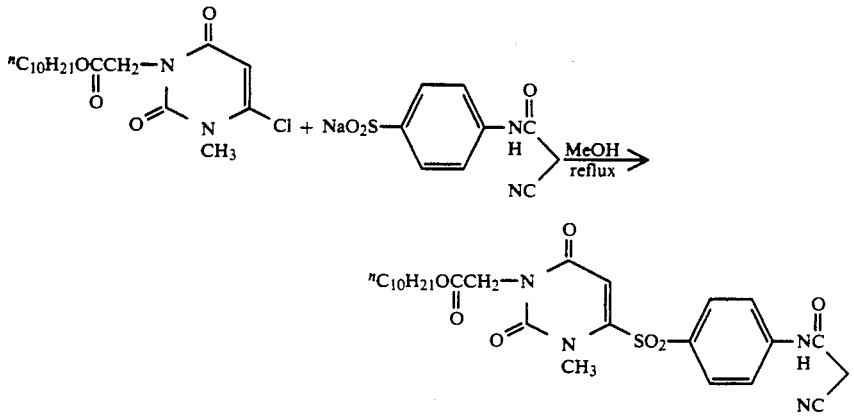

Intermediate 1

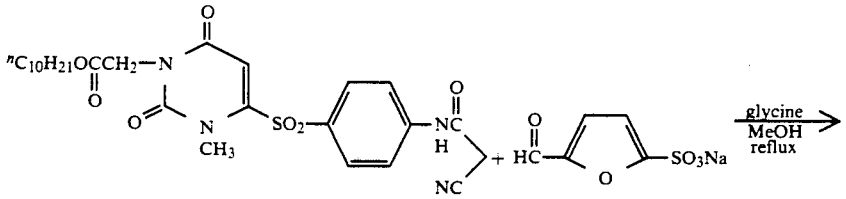

Intermediate 1

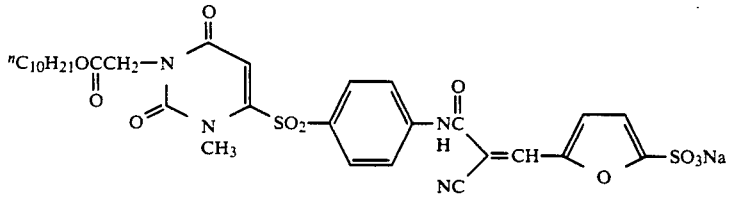

Exemplified Compound (1)

A reaction solution of 5 g of the Intermediate 1, 2 g of sodium 5-formyl-2-furansulfonate, and 0.2 g of glycine in 80 ml of methanol was heated for 6 hours under reflux. After cooling the reaction mixture by allowing it to stand, the deposited crystals were filtered and dried, to obtain 5.2 g of Exemplified Compound (1).

Although the compound represented by formula (I) used in the present invention can be added to a layer in a required amount according to the purpose, preferably it is used to get a optical density in the range of 0.05 to 3.0. Although the specific amount of the dye used varies depending on the type of dye, the desirable amount of the dye can generally be found in the range of $10^{-3}$ g/m$^2$ to 3.0 g/m$^2$, in particular $10^{-3}$ g/m$^2$ to 1.0 g/m$^2$.

The compound represented by formula (I) to be used in the present invention can be incorporated into a hydrophilic colloid layer by various known methods.

For example, the compound can be dissolved in a suitable solvent (e.g., an alcohol, such as methanol, ethanol, and propanol; acetone; methyl ethyl ketone; methyl "Cellosolve"; dimethyl formamide; cyclohexanone; and ethyl acetate) and dissolved or dispersed into gelatin, or dissolved in an oil having a higher boiling point to form fine oil droplets in the form of an emulsified dispersion, and the obtained mixture can be added. As the oil, known oils can be used, such as tricresyl phosphate, diethyl phthalate, dibutyl phthalate, and triphenyl phosphate.

The compound can be added after it is dispersed in an aqueous medium optionally in the presence of a known emulsifier or surface-active agent by stirring or by using ultrasonic waves or a mill. As the emulsifier or surface-active agent, a commonly used anionic, nonionic, cationic, or betaine-type surface-active agent can be used, with particular preference given to an anionic, nonionic, or betaine-type surface-active agent.

The compound of this invention can be incorporated in any position in accordance with the purpose. That is, the present compound can be added into a substrate layer, an antihalation layer between a silver halide emulsion layer and a support, a silver halide emulsion layer, an intermediate layer, a protective layer, a back layer of a support opposite to a silver halide emulsion layer, and a hydrophilic colloid in another assistant layer.

If desired the compound may be added into several layers, or several of the compounds may be added into one layer or several layers independently or as a mixture.

The compound of this invention can be used, if necessary, in combination with various water-soluble dyes as mentioned above, water-soluble dyes adsorbed to a mordant, emulsified and dispersed dyes, or dispersed solid dyes.

As the hydrophilic colloid, gelatins are the most preferable, and various known gelatins can be used. For example, gelatins processed in various ways, such as lime-processed gelatin and acid-processed gelatin, or gelatins obtained by chemically modifying these gelatins, for example by phthalating or sulfonylating can be used. If desired the gelatins are used after desalting.

The mixing ratio of the compound of formula (I) of the present invention and the gelatin is preferably found in the range of $1/10^3$ to 1/3, although the mixing ratio varies depending on the structure and the amount of the compound to be added.

When the layer containing the compound represented by formula (I) of this invention is subjected to development processing, since the compound is decomposed and is dissolved out by hydroquinone, a sulfite, or an alkali in the developer, it does not color or contaminate the photographic image. The time required for the decoloring depends greatly, for example, on the concentration of hydroquinone; on the amount of the sulfite, alkali, or other nucleophilic agent present in a developer or other processing bath; on the type, the amount, and the added position of the present compound, on the amount and the swelling of the hydrophilic colloid; and on the extent of the stirring, and therefore the time required for the decoloring cannot be specified generally. It can be controlled arbitrarily in accordance with the general rule of physical chemistry.

Although the pH of the processing solution varies depending on whether the processing solution is for development, bleaching, fixing, or the like, generally the pH is in the range of 3.0 to 13.0, more preferably in the range of 5.0 to 12.5. Therefore, the compound of this invention is distinguished by a feature that a dye unit can be given off by a processing solution having such a relatively low pH.

Preferably the silver halide emulsion to be used in the present invention is silver bromide, silver bromoiodide, silver bromochloroiodide, silver chlorobromide, or silver chloride.

The silver halide grains to be used in the present invention have a regular crystalline shape, such as a cubic shape or an octahedral shape, or an irregular crystalline shape, such as a sphere shape or a tabular shape, or a composite crystalline shape of these. A mixture of grains having various crystalline shapes can also be used, but grains having a regular crystalline shape are preferably used.

The silver halide grains to be used in the present invention may be grains wherein the phase of the inside is different from that of the outer layer, or they may be grains whose phase is uniform. The silver halide grains to be used in the present invention may be grains wherein a latent image will be formed mainly on the surface, such as a negative-type emulsion, or they may be grains wherein a latent image will be mainly formed inside the grains, such as a internal latent-image-type emulsion or a previously fogged direct-reversal-type emulsion. Grains wherein a latent image is formed mainly on the surface are preferable.

The silver halide emulsion to be used in the present invention is preferably a tabular grain emulsion, wherein the grains have a thickness of 0.5 μm or below, preferably 0.3 μm or below, a diameter preferably of 0.6 μm or over, and an average aspect ratio of 5 or over amount to 50% or more of the total projected area; or it is a monodisperse emulsion wherein the statistical deviation coefficient (in whose value S/d, S stands for the standard deviation and d stands for the diameter, which standard deviation and diameter are obtained in the distribution of diameters by assuming the projected areas to be circles) is 20% or less. Two or more of tabular grain emulsions and monodisperse emulsions may be mixed.

The photographic emulsion to be used in the invention can be prepared by using methods described, for example, by P. Glafkides in *Chimie et Physique Photographeque* (Paul Montel, 1967), by G. F. Duffin in *Photographic Emulsion Chemistry* (Focal Press, 1966), and by V. L. Zelikman, et al. in *Making and Coating Photographic Emulsion* (Focal Press, 1964).

When the silver halide grains are formed, in order to control the growth of the grains, as a silver halide solvent, ammonia, potassium thiocyanate, ammonium thiocyanate, thioether compounds (described, for example, in U.S. Pat. Nos. 3,271,157, 3,574,628, 3,704,130, 4,297,439, and 4,276,374), thion compounds (described, for example, in JP-A Nos. 144319/1978, 82408/1978, and 77737/1980), and amine compounds (described, for example, in JP-A No. 100717/1979) can be used.

In the process of the formation or physical ripening of the silver halide grains, for example, a cadmium salt, a zinc salt, a thallium salt, an iridium salt or its complex salt, a rhodium salt or its complex salt, or an iron salt or its complex salt may be present.

In order to increase the contrast of the silver halide photographic material for the photomechanical process which is a preferable mode of the invention, a hydrazine derivative or a tetrazolium compound can be used.

As a binder or a protective colloid that can be used in emulsion layers or intermediate layers of the present photographic material, gelatin is advantageously used, but other protective colloid can also be used. For example, gelatin derivatives, graft polymers of gelatin with other polymers, albumin, proteins such as casein, cellulose derivatives such as hydroxyethyl celluloses, carboxymethylcelluloses, and cellulose sulfates, sodium alginate, saccharide derivatives such as starch derivatives, and various synthetic hydrophilic polymers including homopolymers and copolymers such as polyvinyl alcohols, polyvinyl alcohol having partial acetals, poly-N-vinyl pyrrolidones, polyacrylic acids, polymethacrylic acids, polyacrylamides, polyvinyl imidazoles, and polyvinyl pyrazoles can also be used.

As gelatin, in addition to generally used lime-processed gelatin, acid-processed gelatin, and enzyme-processed gelatins as described in *Bull. Soc. Sci. Phot. Japan*, No. 16, page 30 (1966) can be used and hydrolyzates of gelatin can also be used.

In the photographic material of the present invention, an inorganic or organic hardening agent may be contained in any hydrophilic colloid layer constituting a photographically sensitive layer or a back layer. For example, a chromium salt, an aldehyde (e.g., formaldehyde, glyoxal, and glutaraldehyde), and a N-methylol compound (e.g., dimethylol urea) can be mentioned as specific examples. An active halogen compound (e.g., 2,4-dichlorohydroxy-1,3,5-triazine and its sodium salt) and an active vinyl compound (e.g., 1,3-bisvinylsulfonyl-2-propanol, 1,2-bis(vinylsulfonylacetamide)ethane, bis(vinylsulfonylmethyl)ether or vinyl polymers having vinylsulfonyl groups as side chains) are preferable, because they harden quickly hydrophilic colloids, such as gelatin, to give stable photographic properties. N-carbamoylpyridinium salts (e.g., (1-morpholinocarbonyl-3-pyridinio)methanesulfonate) and a haloamidinium (e.g., 1-(1-chloro-1-pyridinomethylene)pyrolidinium and 2-naphthalenesulfonato) are also excellent because the hardening rate can be increased.

The silver halide photographic emulsion to be used in the present invention may be photosensitized with a methine dye or the like. The dye for use includes a cyanine dye, a merocyanine dye, a composite cyanine dye, a composite merocyanine dye, a holopolar cyanine dye, a hemicyanine dye, a styryl dye, and a hemioxonol dye. A particularly useful dye is a dye belonging to a cyanine dye, a merocyanine dye, and a composite merocyanine dye. To these dyes, any nucleus generally employed in cyanine dyes as basic heterocyclic nucleus can be applied. That is, for example, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; nucleus formed by fusing an alicyclic hydrocarbon ring to these nucleus; and nucleus formed by fusing an aromatic hydrocarbon ring to these nucleus, i.e., an indolenine nucleus, a benzindolenine nucleus, an indole nucleus, a benzoxadole nucleus, a naphthoxazole nucleus, a benzothiazole nucleus, a naphthothiazole nucleus, a benzoselenazole nucleus, a benzimidazole nucleus, and a quinoline nucleus can be applied. These nuclei may have a substituent(s) on the carbon atom(s).

To the merocyanine dye or the composite merocyanine dye, as a nucleus having a ketomethylene structure, a 5- to 6-membered heterocyclic nucleus, such as a pyrazolin-5-none nucleus, a thiohydantoine nucleus, a -thiooxazolidin-2,4-dione nucleus, a thiazolidin-2,4-dione nucleus, a rhodanine nucleus, and a thiobarbituric acid nucleus can be applied.

These sensitizing dyes may be used alone or in combination and particularly a combination of the sensitizing dyes is often used for supersensitization purposes. In addition to the sensitizing dye, a dye which itself does not have any spectral sensitizing action or a substance which substantially does not absorb visible light but exhibits supersensitization may be included in the emulsion. For example, nitrogen-containing heterocyclic nucleus group-substituted aminostylbene compounds (e.g., those described in U.S. Pat. Nos. 2,933,390 and 3,635,721), aromatic organic acid formaldehyde condensates (e.g., those described in U.S. Pat. No. 3,743,510), cadmium salts, and azaindene compounds may be included. Combinations described in U.S. Pat. Nos. 3,615,613, 3,615,641, 3,617,295, and 3,635,721 are particularly useful.

The silver halide photographic emulsion to be used in this art may contain various compounds for the purpose, for example, of preventing fogging during the process of the preparation of photographic material or during the storage thereof or stabilizing the photographic performance. That is, many compounds known as antifogging agents or stabilizers, for example, azoles, such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; thioketo compounds such as oxadolinthion; azaindenes, such as triazaindenes, tetrazaindenes (particularly 4-hydroxy-substituted (1,3,3a,7)tetrazaindenes) and pentaazaindenes; benzenethiosulfonic acid, benzenesulfinic acid, and benzenesulfonic acid amide can be added.

The photographic material of the present invention may contain one or more surface-active agents for a variety of purposes, for example to aid coating, to prevent static charging, to improve slip property, to assist emulsification and dispersion, to prevent adhesion, and to improve photographic properties (e.g., acceleration of development, contrast increase, and sensitization).

The photographic material prepared according to the present invention may also use as a filter dye a water-soluble dye in the hydrophilic colloid layer for the purpose of preventing irradiation or halation or other purposes. For such a dye, an oxonole dye, a hemioxonol dye, a styryl dye, a melocyanine dye, an anthraquinone dye, and an azo dye can be preferably used, and a cyanine dye, an azomethine dye, a triarylmethane dye, and a phthalocyanine dye are also useful. An oil-soluble dye can be emulsified by the oil-in-water dispersion method, to be added to the hydrophilic colloid layer.

The present invention can be applied to a multi-layer multi-color photographic material having at least two different spectral sensitivities on a support. The multi-layer color photographic material generally has on a support at least one red-sensitive emulsion layer, at least one green-sensitive emulsion layer, and at least one blue-sensitive emulsion layer. The order of the arrangement of these layers may be arbitrarily selected as desired. Preferably layer arrangements are the order of a red-sensitive layer, a green-sensitive layer, and a blue-sensitive layer, stated from the side of the support; the order of a blue-sensitive layer, a green-sensitive layer, and a red-sensitive layer, stated from the side of the support; and the order of a blue-sensitive layer, a red-sensitive layer, and a green-sensitive layer, stated from the side of the support. Arbitrary emulsion layers having the same color sensitivity may be made up of two or more emulsion layers different in sensitivity to improve the sensitivity that will be attained, or they may be made up of three layers to improve graininess. A non-photosensitive layer may be present between two or more emulsion layers having the same color sensitivity. A constitution is possible wherein, between emulsion layers having the same color sensitivity, an emulsion layer having a different color sensitivity is inserted. A reflective layer of a fine-grain silver halide may be provided under a highly sensitive layer, particularly a highly sensitive blue-sensitive layer to improve sensitivity.

Although it is common that a cyan dye-forming coupler is contained in a red-sensitive emulsion layer, a magenta dye-forming coupler is contained in a green-sensitive emulsion layer, and a yellow dye-forming coupler is contained in a blue-sensitive emulsion layer, a different combination can be used in some cases. For example, an infrared sensitive layer is further added for pseudo color photographs or for semiconductor laser exposure.

In the photographic material of the present invention, photographic emulsion layers and other layers are applied to a flexible support, such as plastic films, paper, and fabrics, which are generally used in photographic materials, or to a rigid base, for example of glass, china, or metal. Useful flexible supports are, for example, films made of semi-synthetic or synthetic polymers, such as a cellulose nitrate, a cellulose acetate, a cellulose acetate butylate, a polystyrene, a polyvinyl chloride, a polyethylene terephthalate, and a polycarbonate; and paper coated or laminated with a baryta layer or an α-olefin polymer (e.g., a polyethylene, a polypropylene, and an ethylene/butene copolymer). The support may be colored with a dye or a pigment. The support may be colored black for the purpose of cutting off light.

In the case of a silver halide photographic material for the photomechanical process, which is one preferable mode of the present invention, the support is preferably of a polyethylene terephthalate and there is no particular restriction on the thickness of the support, but the thickness of the support is advantageously on the order of about 12 μm to 500 μm, preferably 40 μm to 200 μm, from the viewpoint of handleability and general-purpose properties. In particular a biaxially orientated and crystallized one is favorable because of stability and strength.

More preferably, a support whose opposite surfaces have a water vapor barrier layer of a vinylidene chloride copolymer is desirable.

Preferably the vinylidene chloride copolymer layer is thicker, because it can prevent the support from extending due to absorption of water during the development processing. However, if it is too thick the adhesion to the silver halide emulsion layer becomes unfavorable.

Therefore the thickness is preferably in the range of 0.3 μm to 5 μm, more preferably 0.5 μm to 2.0 μm.

To apply the photographic emulsion layer and other hydrophilic colloid layer, various known coating methods, such as the dip coating method, the roller coating method, the curtain-flow coating method, and the extrusion coating method can be used. If necessary, many layers may be applied at the same time by the methods described, for example, in U.S. Pat. Nos. 2,681,294, 2,761,791, 3,526,528, and 3,508,947.

The present invention can be applied to various color photographic materials and black-and-white photographic materials. Typical examples are general-purpose or movie color-negative films, color reversal films for slides and television, color papers, color-positive films, color reversal papers, color diffusion transfer photographic materials, and thermal development color photographic materials. The present invention can also be applied to a direct positive color photographic material, which is described in JP-A No. 159847/1988 and which uses a previously not-fogged internal latent-image-type emulsion. The present invention can also be applied to black-and-white photographic materials for radiography by using a black color-forming coupler described, for example, in U.S. Pat. No. 4,126,461 and British Patent No. 2,102,136 or by using three-color coupler mixing described, for example, in *Research Disclosure* No. 17123 (July 1978). The present invention can also be applied to process films, such as lith films and scanner films, direct-clinical/indirect-clinical or industrial radiographic films, negative black-and-white films for photographing, black-and-white photographic papers, COM microfilms, common microfilms, and print-out-type photographic materials.

Various light exposure means can be used for the present photographic material. Any light source that can emit radiation corresponding to the wavelength to which the photographic material is sensitive can be used as a lighting light source or a writing light source. Natural light (sunlight), an incandescent lamp, a halogen atom-sealed lamp, a mercury-arc lamp, a fluorescent lamp, and a flash-light source, such as a strobe and a metal burning flash bulb, are generally used. Lasers of gases, dye solutions, and semiconductors that emit light in the wavelength range from the ultraviolet range to the infrared range, light emission diodes, and plasma light sources can also be used as a recording light source. Further, use can be made of a fluorescent screen that emits fluorescence from a fluorescent substance excited by an electron beam, X-ray, etc. (e.g., CRT and X-ray intensifier foils), a liquid crystal (LCD), and a light exposure means wherein a liner or planar light source is combined with a microshutter array that uses lead titanium zirconate doped with lanthanum (PLZT). If necessary, the spectral distribution used for light exposure can be adjusted by a color filter.

For the photographic processing of the photographic material of this invention, any of known methods and known processing solutions as described in *Research Disclosure,* No. 176, pp. 28 to 30 (RD-17643) can be applied. The photographic processing may be either photographic processing for forming a silver image (black-and-white photographic processing) or photographic processing for forming a color image (color photographic processing), depending on the purpose. The processing temperature is selected generally to be between 18° C. and 50° C.

The developer used in black-and-white photographic processing may contain a known developing agent. As the developing agent, dihydroxybenzenes (e.g., hydroquinone), 3-pyrazolidones (e.g., 1-phenyl-3-pyrazolidone), and aminophenols (e.g., N-methyl-p-aminophenol) can be used alone or in combination. Generally, the developer further contains a known preservative, an alkali agent, a pH buffer, an antifoggant, etc., and it may contain, if necessary, for example, a dissolving aid, a tone modifier, a development accelerator (e.g., a quaternary salt, hydrazine, and benzyl alcohol), a surface-active agent, an antifoamer, a water softener, a hardener (e.g., glutaraldehyde), and a tackifier.

In order to subject the photographic material of this invention to black-and-white reversal photographic processing, any of known development processing techniques for forming a positive-type silver image by reversal development can be used. Any known developer can be used. The processing temperature is selected generally to be between 18° C. and 65° C., but the processing temperature may be lower than 18° C. or higher than 65° C.

The reversal development processing generally consists of the following steps:

First development—washing—bleaching—washing—flashing—second development—fixing—washing—drying.

The developer for use in the black-and-white photographic processing of the first development may contain a known developing agent. As the developing agent, dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, and heterocyclic compounds, for example formed by condensing a 1,2,3,4-tetrahydroquinoline ring with an indolene ring, which are described in U.S. Pat. No. 4,067,872, can be used alone or in combination. In particular, preferably a dihydroxybenzene is used together with a pyrazolidone and/or an aminophenol. Generally the developer may further contain a known preservative, an alkali agent, a pH buffer, an antifoggant, etc., and, if necessary, a dissolving aid, a tone modifier, a development accelerator, a surface-active agent, an antifoamer, a water softener, a hardener, a tackifier, etc. The photographic material of the present invention is generally processed with a developer containing, as a preservative, sulfite ions in an amount of 0.15 mol/liter or more.

Preferably the pH is 8.5 to 11, more preferably 9.5 to 10.5.

In the first developer, use is made of a silver halide solvent, such as NaSCN, in an amount of 0.5 to 6 g/liter.

As the second developer, a commonly used black-and-white developer can be used. That is, the second developer is formed by eliminating the silver halide solvent from the first developer. The pH of the second developer is desirably 9 to 11, particularly preferably 9.5 to 10.5.

In the bleaching solution, use is made of a bleaching agent, such as potassium dichromate and cerium sulfate.

In the fixing solution, preferably use is made of thiosulfate or a thiocyanate and, if necessary, a water-soluble aluminum salt.

As a special type of developing process, a technique may be used wherein a developing agent is contained in the photographic material, for example in the emulsion layer thereof, and the photographic material is developed by processing it in an aqueous alkali solution. Out of developing agents, the hydrophobic developing agent can be contained in the emulsion layer in various ways described, for example, in *Research Disclosure* No. 169 (RD-16928), U.S. Pat. No. 2,739,890, British Patent No. 813,253, or West German Patent No. 1,547,763.

As the fixing solution, a fixing solution having a composition that is generally used can be used. As the fixing agent, a thiosulfate and a thiocyanate, as well as an organic sulfur compound known to have an effect of a fixing agent, can be used. The fixing agent may contain a water-soluble aluminum salt as a hardening agent.

The color developer to be used in development processing of the photographic material of the present invention is preferably an aqueous alkali solution containing as the major component an aromatic primary amine color-developing agent. As the color-developing agent, aminophenol compounds are useful, but p-phenylenediamine compounds are preferably used and typical examples thereof are 3-methyl-4-amino-N,N-diethylaniline, 3-methyl-4-amino-N-ethyl-N-β-hydroxylethylaniline, 3-methyl-4-amino-N-ethyl-N-β-methanesulfonamidoethylaniline, and 3-methyl-4-amino-N-ethyl-N-β-methoxyethylaniline and their sulfates, hydrochlorides, or p-toluenesulfonates. These diamines are generally more stable in the form of salts than in the free form and the salts of the amines are preferably used.

The color developer generally contains, for example, a pH buffer, such as a carbonate, a borate, or a phosphate of an alkali metal and a development retarder or an antifoggant, such as a bromide, an iodide, a benzimidazole, a benzthiazole, or a mercapto compound. If necessary, for example, a preservative, such as a hydroxylamine, a dialkylhydroxylamine, a hydrazine, triethanolamine, triethylenediamine, or a sulfite, an organic solvent, such as triethanolamine and diethylene glycol, a development accelerator, such as benzylalcohol, polyethylene glycol, a quaternary ammonium salt, and an amine, a dye forming coupler, a competing coupler, a nucleating agent, such as sodium boron hydride, an auxiliary developer, such as 1-phenyl-3-pyrazolidone, a tackifier, a variety of chelating agents, for example, represented by aminopolycarboxylic acids, aminopolyphosphonic acids, alkylphosphonic acids, and phosphonocarboxylic acids, and an antioxidant described in West German Patent (OLS) No. 2,622,950, can be added to the color developer.

In the development processing of the reversal color photographic material, generally, black-and-white development is carried out, and then color development is carried out. In this black-and-white developing solution, known black-and-white developing agents, such as dihydroxybenzenes, for example hydroquinone, 3-pyrazolidones, for example 1-phenyl-3-pyrazolidone, and aminophenols, such as N-methyl-p-aminophenols, can be used alone or in combination.

To the photographic material of the present invention, not only a color developer but also any photographic developing means can be applied. As the developing agent for the developer, for example, dihydroxybenzene developing agents, 1-phenyl-3-pyrazolidone developing agents, and p-aminophenol developing agents can be mentioned, which can be used alone or in combination (for example, a combination of a 1-phenyl-3-pyrazolidone with a dihydroxybenzene or a combination of a p-aminophenol with a dihydroxybenzene). The photographic material of the present invention may be processed with a so-called infectious developer that uses a sulfite ion buffer, such as carbonylbisulfite together with hydroquinone.

In the above, the dihydroxybenzene developing agent includes, for example hydroquinone, chlorohydroquinone, bromohydroquinone, isopropylhydroquinone, toluhyddrohydroquinone, methylhydroquinone, 2,3-dichlorohydroquinone, and 2,5-dimethylhydroquinone; the 1-phenyl-3-pyrazolidone developing agent includes, for example 1-phenyl-3-pyrazolidone, 4,4-dimethyl-1-phenyl-3-pyrazolidone, 4-hydroxymethyl-4,-methyl-1-phenyl-3-pyrazolidone, and 4,4-dihydroxymethyl-1-phenyl-3-pyrazolidone; and as the p-aminophenol developing agent, for example p-aminophenol and N-methyl-p-aminophenol will be used. To the developer, a compound that can give free sulfite ions as a preservative is added such as sodium sulfite, potassium sulfite, potassium metabisulfite, and sodium bisulfite. In the case of an infectious developer, formaldehyde sodium bisulfite that give free sulfite ions little in the developer can be used.

As the alkali agent of the developer to be used in the present invention, for example, potassium hydroxide, sodium hydroxide, potassium carbonate, sodium carbonate, sodium acetate, potassium tertiary phosphate, diethanolamine, and triethanolamine can be used. The pH of the developer is generally set at 8.5 or higher, preferably 9.5 or higher.

The developer may contain an organic compound known as an antifoggant or development retarder. Examples thereof are azoles, such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly, 1-phenyl-5-mercaptotetrazole); mercaptopyrimidines; mercaptotriazines; thioketo compounds, such as oxazolinthion; azaindenes, such as triazaindenes, tetraazaindenes (particularly 4-hydroxy-substituted (1,3,3a,7)tetrazaindenes), and pentaazaindenes; benzenethiosulfonic acid, benzenesulfinic acid, benzenesulfonic acid amide, and sodium 2-mercaptobenzimidazole-5-sulfonate.

The developer that can be used in the present invention may contain the same polyalkylene oxide as mentioned above as a development retarder. For example, a polyethylene oxide having a molecular weight of 1,000 to 10,000 may be contained in an amount ranging from 0.1 to 10 g/liter.

To the developer that can be used in the present invention, for example, nitrilotriacetic acid, ethylenediaminetetraacetic acid, triethylenetetramine, xaacetic acid, or diethylenetetraaminepentaacetic acid is preferably added as a water softener.

In the developer that is used in the present invention, as a silver stain preventive agent, a compound described in JP-A No. 24347/1981; as an uneven development-preventive agent, a compound described in JP-A No. 212651/1987; and as a dissolving aid, a compound described in JP-A No. 267759/1986, can be used.

In the developer that is used in the present invention, for example, as a buffer a boric acid described in JP-A No. 186259/1987, a saccharide (e.g., sucrose) described in JP-A No. 93433/1985, an oxime (e.g., acetoxime), a phenol (e.g., 5-sulfosalicylic acid), and a tertiary phosphate (e.g., sodium phosphate and potassium phosphate) can be used.

As the development accelerator to be used in the present invention, various compounds can be used, which may be added either to the photographic material or to the processing solution. As preferable development accelerators, amine compounds, imidazole compounds, imidazoline compounds, phosphonium compounds, sulfonium compounds, hydrazine compounds, thioether compounds, thion compounds, certain mercapto compounds, meso-ion compounds, and thiocyan compounds can be mentioned.

They are needed particularly when rapid development processing is carried out within a short period. Although the development accelerators are desirably added to the color developer, some types of the accelerators can be added to the photographic material, depending on the constitutional position of the photosensitive layer on the support to be subjected to rapid development. They can be added to both the color developer and the photographic material. In some cases a bath is provided to precede the color developing bath, and the development accelerator can be added into it.

Useful amino compounds as amino compounds include both inorganic amines, such as hydroxylamine, and organic amines. The organic amines may be aliphatic amines, aromatic amines, cyclic amines, aliphatic/aromatic mixed amines, and heterocyclic amines and all of primary, secondary, and tertiary amines, and quaternary ammonium compounds are useful.

Generally the photographic emulsion layer is bleached after the color development. The bleaching process may be carried out simultaneously with or separately from the fixing process. In order to make the processing rapid, after the bleaching process, bleach-fix processing may be effected. As the bleaching agent, for example, compounds of polyvalent metals such as iron(III), cobalt(III), chromium(IV), and copper(II), peracids, quinones, and citric compounds are used. As typical bleaching agents, ferricyanides; bichromates; organic complex salts of iron(III) or cobalt (III) such as complex salts of organic acids such as aminopolycarboxylic acids, for example, ethylenediaminetetraacetic acid, diethylenetriaminepentaacetic acid, nitrilotriacetic acid, and 1,3-diamino-2-propanoltetraacetic acid or citric acid, tartaric acid, and malic acid; persulfates; manganates; and nitrosophenol can be used. Out of these, iron(II) ethylenediaminetetraacetate, iron(III) diethylenetriaminepentaacetate, and persulfates are preferable from the viewpoint of rapid processing and preventing of environmental pollution. Further, iron(III) ethylenediaminetetraacetate is particularly useful in an independent bleaching solution as well as in a monobath bleach-fix solution.

In the bleaching solution, the bleach-fix solution, and their preceding bath, a bleaching accelerator can be used if necessary. Specific examples of useful bleaching accelerators are compounds having a mercapto group or a disulfide group described, for example, in U.S. Pat. No. 3,893,858, West German Patent Nos. 1,290,812 and 2,059,988, JP-A Nos. 32736/1978, 57831/1978, 37418/1978, 65732/1978, 72623/1978, 95630/1978, 95631/1978, 104232/1978, 124424/1978, 141623/1978, and 28426/1978, and *Research Disclosure* No. 17129 (July 1978); thiazolidine derivatives as described in JP-A No. 140129/1975; thiourea derivatives described in JP-B ("JP-B" means examined Japanese patent publication) No. 8506/1970, JP-A Nos. 20832/1977 and 32735/1978, and U.S. Pat. No. 3,706,561; iodides described in West German Patent No. 1,127,715 and JP-A No. 16235/1983; polyethylene oxides described in West German Patent Nos. 966,410 and 2,748,430; polyamine compounds described in JP-B No. 8836/1970; and other compounds described in JP-A Nos. 42434/1974, 59644/1974, 94927/1978, 35727/1979, 26506/1980, and 163940/1983, and iodide ions and bromide ions can also be used. Among these, the compounds having a mercapto group or a disulfide group are preferable because the accelerating effect is high and particularly the compounds described in U.S. Pat. No. 3,893,858, West German Patent No. 1,290,812, and JP-A No. 95630/1978 are preferable. Further, the compounds described in U.S. Pat. No. 4,552,834 are preferable. These bleach accelerators may be added to the photographic material. Where the color photographic material for photographing is bleach-fixed, these bleach accelerators are particularly useful.

As a fixing agent, for example, a thiosulfate, a thiocyanate, a thioether compound, a thiourea, and a large amount of an iodide can be mentioned with the use of thiosulfates being common. As a preservative for the bleach-fix solution and the fixing solution, a sulfite, a bisulfite, or a carbonylbisulfurous acid adduct is preferable.

After the bleach-fixing process or fixing process, generally, a washing process and a stabilizing process are carried out. In the washing process and the stabilizing process, various known compounds may be added in order to prevent precipitation and to save water. For example, to prevent precipitation, a water softener, such as an inorganic phosphoric acid, an aminopolycarboxylic acid, an organic aminopolyphosphonic acid, and an organic phosphoric acid may be added; and a bactericide or a mildew-proofing agent for preventing various bacteria, algae, and mildew from generating; and metal salts represented by magnesium salts, aluminum salts, and bismuth salts, various hardeners, or a surface-active agent for preventing drying load or uneven drying, can be added as required. Alternatively, compounds described, for example, by L. E. West in *Phot. Sci. Eng.*, Vol. 6, pp. 34 to 359 (1965) may be added. Particularly, the addition of a chelating agent and a mildew-proofing agent is effective.

Generally the washing process comprises two or more tanks wherein water is run countercurrently to save water. Further, instead of the washing process, a multistage counter-current stabilizing process, as described in JP-A No. 8543/1982, may be carried out. In that process, 2 to 9 counter-current tanks are required. In that stabilizing bath, various compounds for stabilizing images are added in addition to the above-mentioned additives. For instance, various buffers (e.g., combinations of borates, metaborates, borax, phosphates, carbonates, potassium hydroxide, sodium hydroxide, aqueous ammonia, monocarboxylic acids, dicarboxylic acids, and polycarboxylic acids) for adjusting the film pH (for example to 3 to 9) and aldehydes, such as formalin, can be mentioned as typical examples. Further, if required, various additives, such as a chelating agent (e.g., an inorganic phosphoric acid, an aminopolycarboxylic acid, an organic phosphoric acid, an organic phosphonic acid, an aminopolyphosphonic acid, and a phosphonocarboxylic acid), a bactericide (e.g., benzoisothiazolinone, isothiazolone, 4-thiazolinebenzimidazole, a halogenated phenol, sulfanilamide, and benztriazole), a surface-active agent, a brightening agent, and a hardener, may be used and two or more compounds that are intended for the same purpose or different purposes may be used.

As a film pH-adjusting agent after the processing, various ammonium salts, such as ammonium chloride, ammonium nitrate, ammonium sulfate, ammonium phosphate, ammonium sulfite, and ammonium thiosulfate, are preferably added.

For the color photographic material for photographing, the washing/stabilizing process generally carried out after the fixing can be replaced with the above-mentioned stabilizing process and the washing process (water saving process). In this case, if the magenta coupler is two-equivalent, the formalin in the stabilizing bath may be omitted.

Although the time required for the washing process and the stabilizing process in the present invention varies depending on the type of the photographic material and the processing conditions, it is generally 20 sec to 10 min, preferably 20 sec to 5 min.

In order to simplify the process or make the process rapid, the silver halide color photographic material of this invention may contain a color developer therein. To contain a color developer in the color photographic material of this invention, various precursors for color-developing agents are preferably used. For example, the following can be mentioned: indoaniline compounds described in U.S. Pat. No. 3,342,597, Schiff base type compounds described in U.S. Pat. No. 3,342,599 and *Research Disclosure* Nos. 14850 and 15159, aldol compounds described in ibid. No. 13924, metal salt complexes described in U.S. Pat. No. 3,719,492, urethane compounds described in JP-A No. 135628/1978 as well as various salt type precursors described, for example, in JP-A Nos. 6235/1981, 16133/1981, 59232/1981, 67842/1981, 83734/1981, 83735/1971, 83736/1981, 89735/1981, 81837/1981, 54430/1981, 106241/1981, 107236/1981, 97531/1982, and 83565/1982.

The silver halide color photographic material of the present invention may contain, if necessary, various 1-phenyl-3-pyrazolidones therein in order to accelerate the color development. Typical compounds are described, for example, in JP-A Nos. 64339/1981, 144547/1982, 211147/1982, 50532/1983, 50536/1983, 50533/1983, 50534/1983, 50535/1983, and 115438/1983.

Various processing solutions in the present invention are used at about 10° C. to about 50° C. Although a temperature of about 33° C. to about 38° C. is standard, a higher temperature may be used to accelerate the processing to shorten the processing time, or conversely a lower temperature can be used to attain an improvement in the image or in the stability of the processing solution. Further, in order to save the silver in the photographic material, processing using cobalt intensification or hydrogen peroxide intensification described in West German Patent No. 2,226,770 or U.S. Pat. No. 3,674,499 can be carried out.

If necessary a heater, a temperature sensor, a liquid level sensor, a circulating pump, a filter, a floating lid, a squeegee, etc., may be provided in each of the various processing baths.

In the continuous processing, a replenisher for each processing solution is used to prevent the solution composition from changing, thereby obtaining constant finish. To reduce the cost, the amount of the replenisher can be reduced to half or less of the standard replenishing amount.

If the photographic material of the present invention is a color paper, quite generally it is subjected to bleach-fix processing, or if the photographic material of the present invention is a color photographic material for photographing, it is subjected to bleach-fix processing as required.

The development processing time in the present invention refers to the period between the time the forward end of the photographic material reaches the developer and the time the forward end leaves the final drying zone in the automatic processor processing.

The use of the compound of the present invention has made it possible to provide a silver halide photographic material high in mordanting property and free from residual color stain due to development processing.

Now the present invention will be described with reference to the following Examples specifically, but the present invention is not limited to them.

EXAMPLE 1

On a polyethylene terephthalate base having a thickness of 180 μm, one surface of which was coated with gelatin as a subbing coat, coating was carried out as follows:

(1) A layer containing gelatin in an amount of 2.0 g/m$^2$ and 1,3-bisvinylsulfonyl-2-propanol.

(2) A layer containing gelatin in an amount of 1.0 g/m$^2$, a compound listed in Table 1 in an amount of 0.12 mmol/m$^2$, a below-mentioned betaine-type surface-active agent a in an amount of 0.17 mmol/m$^2$, and 1,3-bisvinylsulfonyl-2-propanol. Surface-active agent a:

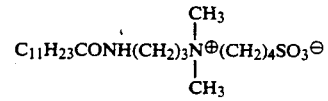

The compound listed in Table 1 was dissolved in a small amount of dimethylformamide and the solution was added with stirring before the hardener of the coating solution of the layer (2) was added.

The spectral absorption spectrum of these coated samples was measured (using HITACHI U-3210 model Spectrophotometer, manufactured by K.K. Hitachi Seisakusho) and the maximum absorption wavelength and the absorbance and the half band width at the maximum absorption wavelength are given in Table 1.

As a Comparative Sample, instead of the layer (2) above, a layer containing gelatin in an amount of 1.0 g/m$^2$, a below-mentioned dye A in an amount of 0.12 mmol/m$^2$, and 1,3-bisvinylsulfonyl-2-propanol was coated, the dye A being dispersed by the method described as an example in International Application Publication (WO) No. 88/04794.

Dye A:

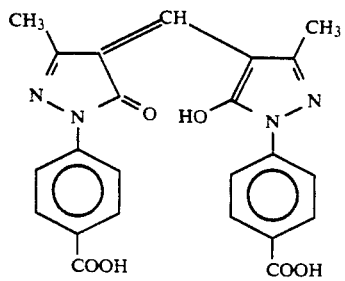

As another Comparative Sample, instead of the layer (2) above, a layer containing gelatin in an amount of 1.0 g/m$^2$, a below-mentioned dye B in an amount of 0.12 mmol/m$^2$, the above betaine-type surface-active agent in an amount of 0.17 mmol/m$^2$, and 1,3-bisvinylsulfonyl-2-propanol was coated.

The dye was added after it was dissolved in a small amount of dimethylformamide.

Dye B:

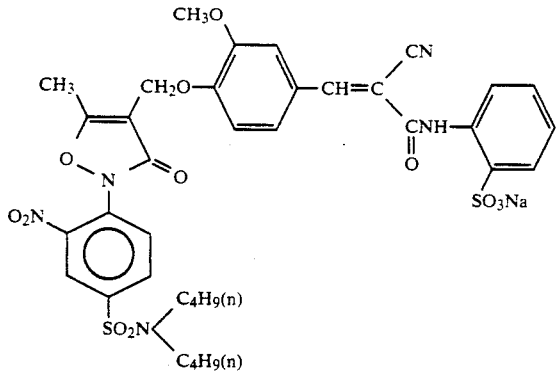

TABLE 1

| Coated Sample | Compound No. | Maximum Absorption Wave-length (nm) | Absor-bance | Half Band Width (nm) | Immobilized Ratio (%) | Residual Color Ratio (%) |
|---|---|---|---|---|---|---|
| Comparison | A | 368 | 0.158 | 126 | 96 | 0 |
| Comparison | B | 366 | 0.242 | 74 | 90 | 28 |
| This Invention | 1 | 351 | 0.233 | 63 | 93 | 0 |
| This Invention | 6 | 355 | 0.245 | 65 | 99 | 0 |
| This Invention | 7 | 345 | 0.286 | 68 | 98 | 0 |
| This Invention | 3 | 372 | 0.239 | 76 | 93 | 0 |
| This Invention | 13 | 372 | 0.239 | 76 | 93 | 0 |

As is apparent from the results of Table 1, in comparison with the dispersed solid dyes, the compound of the present invention is small in half band width in general, has sharp absorption characteristics, and is high in absorbance.

This makes apparent that the dye of the present invention can exhibit excellent performance as a dye for a filter and also can exhibit excellent performance as a dye for antihalation for photographic materials which will be exposed to light having a specific wavelength.

EXAMPLE 2

The Samples in Example 1 were dipped for 5 min in a phosphoric acid buffer solution of pH 5; then they were washed slightly with water and dried. The absorbance after the dipping was divided by the absorbance before the dipping, to obtain the immobilized ratio (in %); and the results are shown in Table 1.

Further, the Samples in Example 1 were subjected to a decoloring test by using an automatic processor, FG-310 PTS, manufactured by Fuji Photo Film Co., Ltd., for a developing time of 20 sec at 38° C. The processed and dried Samples were further subjected to an aging test at 50° C. and 65% RH for 3 days, and the absorbance was measured. The decoloring was expressed by the residual color ratio of the absorbance after the aging test to the absorbance before the aging test. Use was made of, respectively as the developer and the fixing solution, LD-835 and LF-308, manufactured by Fuji Photo Film Co., Ltd.

As is apparent from the results of Table 1, the dye of the present invention is substantially satisfactorily immobilized and can be immobilized in a particular layer, and in addition that, as is apparent from comparison with the Dye B, the dye of the present invention is excellent in discoloring property in the processing.

EXAMPLE 3

The First Photosensitive Emulsion Layer

Preparation of Photosensitive Emulsion A

An aqueous silver nitrate solution having a concentration of 0.37M and an aqueous halide solution containing an $(NH_4)_3RhCl_6$ is an amount corresponding to $1\times10^{-7}$ mol per mol of silver, $K_3IrCl_6$ in an amount of $5\times10^{-7}$ mol, 0.11M of potassium bromide, and 0.27M of sodium chloride, were added to an aqueous gelatin solution containing sodium chloride and 1,3-dimethyl-2-imidazolidinethion at 45° C. over 12 min by the double jet method with stirring, to obtain silver chlorobromide grains having an average grain size of 0.20 μm and a silver chloride content of 70 mol %, thereby forming nuclei. Further, similarly, an aqueous halide solution containing 0.63M of an aqueous silver nitrate solution, 0.19M of potassium bromide, and 0.47M of sodium chloride was added, over 20 min by the double jet method. Thereafter, a KI solution in an amount of $1\times10^{-3}$ mol was added, to effect the conversion, followed by washing by the flocculation method in the usual manner; then 40 g of gelatin was added, the pH was adjusted to 6.5 and the pAg was adjusted to 7.5. Then sodium thiosulfate, chloroauric acid, and sodium benzenethiosulfonate in respective amounts of 5 mg, 8 mg, and 7 mg per mol of silver, were added. The mixture was heated at 60° C. for 45 min, to be chemically sensitized, and, as a stabilizer, 1,3,3a,7-tetrazaindene in an amount of 150 mg, proxel, and phenoxyethanol were added. The obtained grains were silver chlorobromide cubic grains having an average grain size of 0.28 μm and a silver chloride content of 70 mol %. (deviation coefficient of grain size distribution: 9%).

Coating of the First Photosensitive Emulsion Layer

These emulsions were divided, and to each were added 5-[3-(4-sulfobutyl)-5-chloro-2-oxazolidilidene]-1-hydroxyethyl-3-(2-pyridyl) -2-thiohydantoin, as a sensitizing dye, in an amount of $1\times10^{-3}$ mol per mol of silver; 1-phenyl-5-mercaptotetrazole, in an amount of $2\times10^{-4}$ mol; a short wavelength-absorbong cyanine dye, which is Compound (a), represented by the structure shown below, in an amount of $5\times10^{-4}$ mol; a polymer, which is Compound (b) (200 mg/m$^2$); hydroquinone (50 mg/m$^2$); a dispersion of polyethyl acrylate (200 mg/m$^2$); 1,3-bisvinyl-sulfonyl-2-propanol (200 mg/m$^2$); as a hardener, and Hydrazine Compound (c), shown below, and the thus obtained emulsion was coated so that the coating amount of silver might be 3.6 g/m$^2$ and the gelatin might be 2.0 g/m$^2$.

Compound (a)

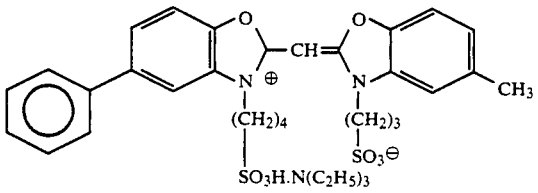

Compound (b)

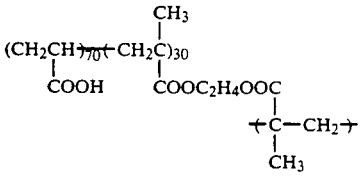

Hydrazine Compound (c)

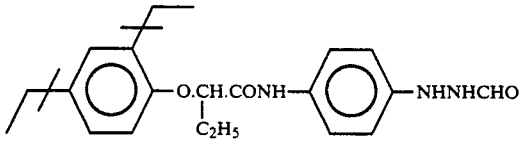

$2.8\times10^{-5}$ mol/m$^2$

| (Coating of an intermediate layer) | |
|---|---|
| Gelatin | 1.0 g/m$^2$ |
| 1,3-Bisvinylsulfonyl-2-propanol | 4.0 wt % (based on gelatin) |

The Second Photosensitive Emulsion Layer

Preparation of Photosensitive Emulsion B

An aqueous silver nitrate solution having a concentration of 1.0M and an aqueous halide solution containing $(NH_4)_3RhCl_6$ in an amount of $3\times10^{-7}$ mol per mol of silver, $K_3IrCl_6$ in an amount of $5\times10^{-7}$ mol, 0.3M of potassium bromide, and 0.74M of sodium chloride, were added to an aqueous gelatin solution containing sodium chloride and 1,3-dimethyl-2-imidazolidinethion at 45° C. over 30 min by the double jet method with stirring, to obtain silver chlorobromide grains having an average grain size of 0.28 μm and a silver chloride content of 70 mol %. Thereafter, the silver chlorobromide grains were washed by the flocculation method in the usual manner; then 40 g of gelatin was added, the pH was adjusted to 6.5 and the pAg was adjusted to 7.5, and then sodium thiosulfate and chloroauric acid in respective amounts of 5 mg and 8 mg per mol of silver, were added. The mixture was heated at 60° C. for 60 min, to be chemically sensitized, and, as a stabilizer, 1,3,3a,7-tetrazaindene in an amount of 150 mg was added. The obtained grains were silver chlorobromide cubic grains having an average grain size of 0.28 μm and a silver chloride content of 70 mol%. (deviation coefficient of grain size distribution: 10%).

Coating of the Second Photosensitive Emulsion Layer

The Photosensitive Emulsion B was redissolved, 5-[3-(4-sulfobutyl)-5-chloro-2-oxazolidilidene]-1-hydroxyethyl-3-(2-pyridyl) -2-thiohydantoin, as a sensitizing dye, in an amount of $1\times10^{-3}$ mol per mol of silver, and KI solution, in an amount of $1.0\times10^{-3}$ mol, were added thereto; further 1-phenyl-5-mercaptotetrazole, in an amount of $2\times10^{-4}$ mol; a dispersion of polyethyl acrylate, in an amount of 50 mg/m$^2$; and 1,3-bisvinylsulfonyl-2-propanol, as a hardener, in an amount of 4.0 wt % based on the gelatin, were added thereto. The thus obtained emulsion was coated so that the coating amount of silver might be 0.4 g/m$^2$ and the gelatin might be 0.5 g/m$^2$.

Coating of the Protective Layer

Thereon was coated, as a protective layer, 1.5 g/m$^2$ of gelatin, 0.1 g/m$^2$ of Compound 1 of the present invention, and 0.3 g/m$^2$ of polymethyl methacrylate particles (having an average particle diameter of 2.5 μm) by using the following surface-active agents.

| | |
|---|---|
| 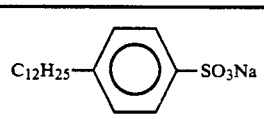 | 37 mg/m$^2$ |
| $CH_2COOC_6H_{13}$<br>$CHCOOC_6H_{13}$<br>$SO_3Na$ | 37 mg/m$^2$ |
| $C_8F_{17}SO_2N(C_3H_7)CH_2COOK$ | 2.5 mg/m$^2$ |

The Compound of the present invention was dissolved in a minimum amount of dimethylformamide, and the obtained solution was added to gelatin solution with stirring.

A back layer and a back protective layer having the formulations given below were coated.

(Formulation of the back layer)

-continued

| | |
|---|---|
| Gelatin | 3 g/m² |
| Latex (polyethylene acrylate) | 2 g/m² |
| Surface active agent (sodium p-dodecylbenzenesulfonate) | 40 mg/m² |
| Gelatin-hardener | 110 mg/m² |

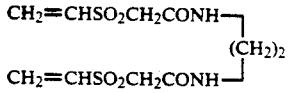

Mixture of Dyes (a), (b), and (c):

| | |
|---|---|
| Dye (a) | 50 mg/m² |
| Dye (b) | 100 mg/m² |
| Dye (c) | 50 mg/m² |

Dye (a)

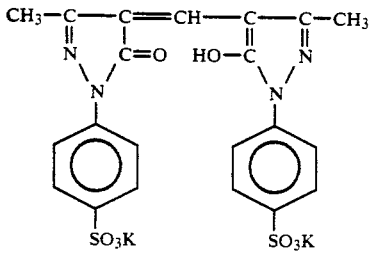

Dye (b)

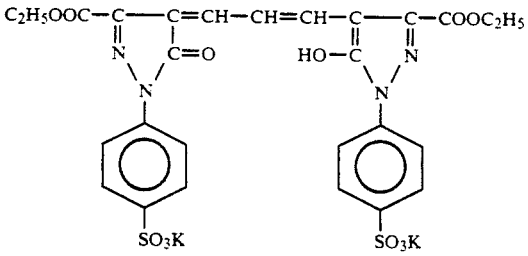

Dye (c)

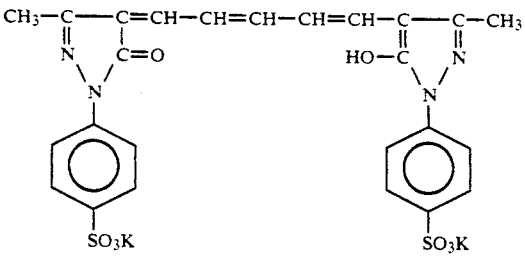

(The back protective layer)

| | |
|---|---|
| Gelatin | 0.8 g/m² |
| Poly(methyl methacrylate) fine particles (average particle diameter: 4.5 μm) | 30 mg/m² |
| Sodium dihexyl-α-sulfosuccinate | 15 mg/m² |
| Sodium dodecylbenzenesulfonate | 15 mg/m² |
| Sodium acetate | 40 mg/m² |
| Fluorine surface-active agent $C_8F_{17}SO_2N(C_3H_7)CH_2COOK$) | 5 mg/m² |

On a support of polyester film (100 μm) were coated the first photosensitive emulsion layer (the lower most layer) then the second photosensitive emulsion layer containing the redox compound with the intermediate layer between the first and second layers, and the protective layer on the second layer, thereby preparing Coated Sample 3-1.

Similarly to Coated Sample 3-1, Coated Sample 3-2 was prepared by using, instead of Compound 1, Compound 6. (Preparation of Comparative Samples)

(1) A sample was prepared by removing Compound 1 from Coated Sample 3-1 and was named Comparative Coated Sample 3-3.

(2) A sample was prepared in the same way as that for Coated Sample 3-1, except that instead of Compound 1 the following water-soluble ultraviolet-absorbing dye (0.05 g/m²) was used and the obtained sample was named Comparative Coated Sample 3-4.

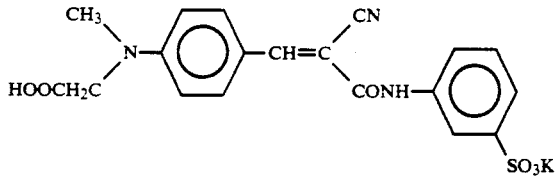

Evaluation of the Performance (1) The above four Samples were exposed to light through an optical wedge using a daylight room printer, P-607, manufactured by Dainippon Screen K.K., then were developed at 38° C. for 20 sec using an automatic processor, FG 680 A, manufactured by Fuji Photo Film Co., Ltd., and were fixed, washed, and dried in a usual manner. The UV optical density at the highlight section of Samples 3-1, 3-2, and 3-4 was as low as that of Sample 3-3 and was decolored completely.

| Developer | |
|---|---|
| Hydroquinone | 50.0 g |
| N-methyl-p-aminophenol | 0.3 g |
| Sodium hydroxide | 18.0 g |
| 5-Sulfosalicylic acid | 30.0 g |
| Boric acid | 25.0 g |
| Potassium sulfite | 24.0 g |
| Disodium ethylenediaminetetraacetic acid | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)-benzenesulfonate | 0.2 g |
| N-n-Butyldiethanolamine | 15.0 g |
| Sodium toluenesulfonate | 8.0 g |
| Water to make | 1 liter |
| pH (adjusted by adding potassium hydroxide) | 11.6 |

Based on Comparative Sample 3-3, the sensitivity of Comparative Sample 3-4 could be reduced by 0.4 in terms of the log E value, and the sensitivity of Samples 3-1 and 3-2 of the present invention could be reduced by 0.43 in terms of the log E value. Practically, the sensitivities of Samples 3-1 and 3-4 were in a suitable range.

(2) Test of Safelight Aptitude

The safety time of the above four Samples was tested under 400 lux by a UV-cut fluorescent lamp (FLR-40SW-DLX-NU-M manufactured by Toshiba K.K.), which is a safelight. The safety time of Comparative Sample 3-3 was 10 min, that of Comparative Sample 3-4 was 20 min, and that of Samples 3-1 and 3-2 of the present invention was 25 min.

From the results of the test under (1) and (2), it can be understood that Compounds 1 and 6 of the present invention can lower effectively the sensitivity to a suitable range and can increase safelight aptitude.

(3) Test of Tone Variability

The above four Samples were exposed to light through a screen tint by the above printer and were developed similarly to the test under (1). After the exposure time that could turn the dot area of each Sample to 1:1 was determined, exposure of each Sample to light was effected for exposure times that were respectively 2 times and 4 times the above determined exposure time, and to what extent the dot area was enlarged was examined. It is indicated that the more the dot area is enlarged, the more excellent the tone variability is. The results are shown in Table 2.

TABLE 2

| Tone Variability (shown in an increment of dot area) | Exposure Time | |
|---|---|---|
| | 2 times | 4 times |
| Comparative Sample 3-3 | +5% | +9% |
| Comparative Sample 3-4 | +2% | +4% |
| Sample of This Invention 3-1 | +5% | +9% |
| Sample of This Invention 3-2 | +5% | +9% |

As is apparent from the results in Table 2, the tone variability of Comparative Sample 3-4 lowers extremely, whereas the tone variability of Samples 3-1 and 3-2 of the present invention is high. This is regarded as resulting from the fact that the dye used in Comparative Sample 3-4 is soluble in water and diffusible, so that the dye had diffused uniformly into the photosensitive emulsion layer from the layer in which it was added during the coating and drying, and therefore even when the exposure time was increased, the dot area was restrained from enlarging by the irradiation-preventing effect of the particular dye. On the other hand, since Compounds 1 and 6 of the present invention were immobilized in the layer where they were added, high tone variability was exhibited.

Having described our invention as related to the embodiment, it is our intention that the invention be not limited by any of the details of the description, unless otherwise specified, but rather be construed broadly within its spirit and scope as set out in the accompanying claims.

What we claim is:

1. A silver halide photographic material, which comprises at least one compound represented by the following Formula (I)

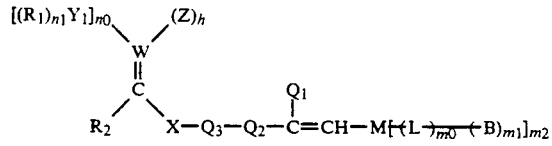

wherein $R_1$ and $R_2$ each represent a hydrogen atom or a group being capable of substitution; W represents a nitrogen atom or a carbon atom; Z represents $—Y_1—(R_3)_{n2}$ or $R_3$ in which $R_3$ represents a hydrogen atom or a group being capable of substitution; $n_0$, $n_1$, and $n_2$ each are 0 or 1; h is 1 or 2; $R_1$, $R_2$, and $R_3$ may bond together to form a carboxylic ring or a heterocyclic ring; when $n_1$ in $(R_1)_{n1}$ or $n_2$ in $(R_3)_{n2}$ is 1, the corresponding $Y_1$ represents —CO—, $—C(=NR_4)—$, —C(=S)—, $—C(=N^+R_5R_6)—$, —SO—, $—SO_2—$, $—C(=CR_7R_8)—$, $—R_6C=N$, or $—R_6C=CR_9—$, in which $R_4$, $R_5$, $R_6$, $R_7$, $R_8$, and $R_9$ each represent a hydrogen atom or a group being capable of substitution; when $n_1$ in $(R_1)_{n1}$ or $n_2$ in $(R_3)_{n2}$ is 0, the corresponding $Y_1$ represents a cyano group or a nitro group; X represents a divalent linking group bonded to the carbon atom through a heteroatom; $Q_1$ represents an electron-attractive group; $Q_2$ represents a group for stabilizing the negative charge that will result from the addition of a nucleophilic agent to the adjacent unsaturated bond; $Q_3$ represents a divalent linking group; M represents a furan ring or a benzofuran ring; L represents a $(m_1+1)$-valent linking group; B represents a group capable of making the compound water-soluble; $m_0$ is 0 or 1; and $m_1$ and $m_2$ each are 1, 2, or 3.

2. The silver halide photographic material as claimed in claim 1, wherein $R_1$ in formula (I) represents a hydrogen atom, an alkyl group, an alkenyl group, an aryl group, an alkoxy group, an aryloxy group, an alkylthio group, an arylthio group, an amino group, or a hydroxyl group.

3. The silver halide photographic material as claimed in claim 1, wherein $R_2$ in formula (I) represents a hydrogen atom, a halogen atom, an alkyl group, an aryl group, an alkoxy group, an aryloxy group, an alkylthio group, an arylthio group, an acyloxy group, an amino group, an carbonamido group, a ureido group, a carboxyl group, a carbonate group, an oxycarbonyl group, a carbamoyl group, an acyl group, a sulfo group, a sulfonyl group, a sulfinyl group, a sulfamoyl group, a cyano group, or a nitro group.

4. The silver halide photographic material as claimed in claim 1, wherein $Y_1$ in formula (I) represents a halogen atom, an alkyl group, an alkenyl group, an aryl group, an alkoxy group, an aryloxy group, an acyloxy group, an amino group, a carbonamido group, a ureido group, an oxycarbonyl group, a carbamoyl group, an acyl group, a sulfonyl group, a sulfinyl group, a sulfamoyl group, a cyano group, or a nitro group.

5. The silver halide photographic material as claimed in claim 1, wherein $Q_1$ in formula (I) represents a cyano group, $—COOR_{10}$, $—C(=O)—R_{10}$, $—SOR_{10}$, $—SO_2R_{10}$, $—SO_2NR_{10}R_{11}$, and $—ONR_{10}R_{11}$, wherein $R_{10}$ and $R_{11}$ each represent a hydrogen atom or a group being capable of substitution.

6. The silver halide photographic material as claimed in claim 1, wherein $Q_2$ in formula (I) is represented by the following formula (II):

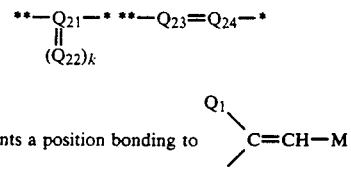

Formula (II)

*represents a position bonding to

**represents a position bonding to $Q_3$ wherein $Q_{21}$ represents a carbon atom or a sulfur atom, $Q_{22}$ represents an oxygen atom, $=N—R_{12}$, or $=CR_{12}R_{13}$, $Q_{23}$ represents $—CR_{14}=$ or $—N=$, and $Q_{24}$ represents $=CR_{15}$ or $=N—$ in which $R_{12}$, $R_{13}$, $R_{14}$, $R_{15}$ each represent a hydrogen atom or a group being capable of substitution, and k is 1 or 2.

7. The silver halide photographic material as claimed in claim 1, wherein $Q_3$ in formula (I) represents a divalent linking group made up of an alkylene group, an alkenylene group, an arylene group, or an aralkylene group, and an oxygen atom, a nitrogen atom, or a sulfur atom.

8. The silver halide photographic material as claimed in claim 1, wherein $Q_1$, $Q_2$, and $Q_3$ in formula (I) bond together to form a carbocyclic ring or heterocyclic ring.

9. The silver halide photographic material as claimed in claim 8, wherein the carbocyclic ring formed by $Q_1$, $Q_2$, and $Q_3$ is dimedone or 1,3-indanedione.

10. The silver halide photographic material as claimed in claim 8, wherein the heterocyclic ring, formed by $Q_1$, $Q_2$, and $Q_3$ is pyrazolone, hydroxypyridone, barbituric acid, pyrazolopyridone, pyrazolidinedione, furanone, thiobarbituric acid, rhodanine, hydantoin, oxazolidin-4-one-2-thione, pyrimidine-2,4-dione, homophthalimide, 1,2,3,4-tetrahydroquinolin-2,4-dione, 2-isoxazolin-5-one, pyrazolopyrimidine, pyrrolidone, pyrazoloimidazole, or pyrazolotriazole.

11. The silver halide photographic material as claimed in claim 1, wherein the divalent linking group represented by X in formula (I) is —O—, —OCO—, —$SO_2$—, or —$OSO_2$—.

12. The silver halide photographic material as claimed in claim 1, wherein L in formula (I) is represented by the following formula (III):

$$-L_0\text{-}(A)_{m_3}\text{-}L_1\text{-}_{m_4} \qquad \text{Formula (III)}$$

wherein $L_0$ and $L_1$ each represent a divalent linking group, A represents an oxygen atom, a nitrogen atom, or a sulfur atom and $m_3$ and $m_4$ each are 0 or 1.

13. The silver halide photographic material as claimed in claim 1, wherein B in formula (I) is a carboxylic acid group, a sulfonic acid group, a sulfinic acid group, a phosphoric acid group, or a amphoteric water-solubilizing group.

14. The silver halide photographic material as claimed in claim 1, wherein the compound represented by formula (I) is selected from the group constituting of compounds represented by the following formulae (IV) and (V):

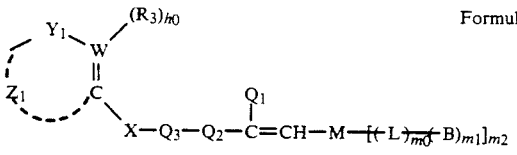

Formula (IV)

-continued

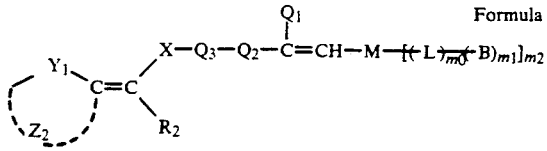

Formula (V)

wherein $Z_1$ and $Z_2$ each represent a group of atoms required to form a carbocyclic ring or heterocyclic ring, $Y_1$, W, $R_2$, $R_3$, X, $Q_1$, $Q_2$, $Q_3$, M, L, B, $m_0$, $m_1$, and $m_2$ each have the same meanings as those of each identical notation in formula (I) and $h_0$ is 0 or 1.

15. The silver halide photographic material as claimed in claim 14, wherein the compound represented by formula (I) is represented by formula (IV).

16. The silver halide photographic material as claimed in claim 14, wherein the ring formed by $Z_1$ in formula (IV) is cyclopentenone, cyclohexenone, cycloheptenone, benzocycloheptenone, benzocyclopentenone, benzocyclohexenone, 4-pyridone, 4-quinolone, quinone-2-pyrone, 4-pyrone, 1-thio-2-pyrone, 1-thio-4-pyrone, cumarin, chromone, uracil, imidazoline, thiazoline, oxazoline, pyrrole, oxazole, thiazole, imidazole, triazole, tetrazole, pyridine, pyrimidine, pyrazine, pyridazine, triazine, quinoline, isoquinoline, phthalazine, quinazoline, quinoxaline, benzothiazole, benzoxazole, benzoimidazole, naphthilidine, thiasolo[4,5-d]pyrimidine, 4H-pyrido[1,2-a]pyrimidine, imidazo[1,2-a]-pyridine, [pyroro[1,2-a]pyrimidine, 1H-pyroro[2,3-b]-pyridine, 1H-pyroro[3,2-b]pyridine, 6H-pyroro[3,4-b]pyridine] pyrrolo[1,2-a]pyrimidine, 1H-pyrrolo[2,3-b]-pyridine, 1H-pyrrolo[3,2-b]pyridine, 6H-pyrrolo[3,4-b]-pyridine, benzoimidazole, or one selected from triazaindenes, tetraazaindenes, and pentaazaindenes.

17. The silver halide photographic material as claimed in claim 14, wherein $R_3$ in formula (IV) represents a hydrogen atom, a halogen atom, an arylthio group, an oxycarbonyl group, a carbamoyl group, an acyl group, a sulfonyl group, a sulfamoyl group, a sulfinyl group, a nitro group, or a cyano group.

18. The silver halide photographic material as claimed in claim 14, wherein the ring formed by $Z_2$ in formula (V) is a cyclopentanone, a cyclohexanone, a cycloheptanone, a benzocycloheptanone, a benzocyclopentanoe, a benzocyclohexanone, 4-tetrahydropyridone, 4-dihydroquinolone, or 4-tetrahydropyrone.

19. The silver halide photographic material as claimed in claim 1, wherein the compound represented by formula (I) is contained in the amount of $10^{-3}$ g to 3.0 g, per $m^2$ of the photographic material.

* * * * *